US011456550B2

(12) United States Patent
Nishitani et al.

(10) Patent No.: US 11,456,550 B2
(45) Date of Patent: Sep. 27, 2022

(54) FEMALE TERMINAL WITH A PLURALITY OF SPRING MEMBERS AND A PROJECTING PORTION

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Akihiro Nishitani, Mie (JP); Masaaki Tabata, Mie (JP); Teruo Hara, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 4 days.

(21) Appl. No.: 17/278,325

(22) PCT Filed: Sep. 26, 2019

(86) PCT No.: PCT/JP2019/037803
§ 371 (c)(1),
(2) Date: Mar. 21, 2021

(87) PCT Pub. No.: WO2020/071226
PCT Pub. Date: Apr. 9, 2020

(65) Prior Publication Data

US 2021/0351533 A1 Nov. 11, 2021

(30) Foreign Application Priority Data

Oct. 2, 2018 (JP) ..... JP2018-187561

(51) Int. Cl.
*H01R 13/02* (2006.01)
*H01R 13/11* (2006.01)
*H01R 4/18* (2006.01)

(52) U.S. Cl.
CPC ..... *H01R 13/11* (2013.01); *H01R 4/18* (2013.01)

(58) Field of Classification Search
CPC ..... H01R 13/11; H01R 13/10; H01R 13/02; H01R 4/18
(Continued)

(56) References Cited

U.S. PATENT DOCUMENTS 5,607,328 A * 3/1997 Joly ..... H01R 13/11 439/852
5,630,738 A * 5/1997 Ito ..... H01R 13/113 439/852
(Continued)

FOREIGN PATENT DOCUMENTS

JP H04-081484 U 7/1992
JP 2001-210418 A 8/2001
(Continued)

OTHER PUBLICATIONS

International Search Report dated Nov. 26, 2019 for WO 2020/071226 A1 (4 pages).

*Primary Examiner* — Harshad C Patel
(74) *Attorney, Agent, or Firm* — Venjuris, P.C.

(57) ABSTRACT

A female terminal includes a terminal connecting portion extending along a length direction and having an insertion opening on a front end in the length direction, a male terminal being inserted into the insertion opening, a resilient contact piece disposed inside the terminal connecting portion and configured to sandwich the male terminal between the terminal connecting portion and the resilient contact piece, a plurality of spring members disposed side by side
(Continued)

across a gap along the length direction inside the terminal connecting portion and configured to resiliently contact the male terminal from one side in a width direction intersecting the length direction and the height direction, and a projecting portion projecting from the other side in the width direction toward the one side in the width direction inside the terminal connecting portion and configured to sandwich the male terminal between the plurality of spring members and the projecting portion.

9 Claims, 33 Drawing Sheets

(58) Field of Classification Search
USPC ..... 439/862
See application file for complete search history.

(56) References Cited

U.S. PATENT DOCUMENTS 5,695,368 A * 12/1997 Joly ..... H01R 13/434 439/748
7,470,159 B2 * 12/2008 Hara ..... H01R 13/113 439/852
7,717,759 B2 * 5/2010 Ishigami ..... H01R 13/114 439/852
7,985,106 B2 * 7/2011 Sugiyama ..... H01R 13/113 439/852
8,905,798 B2 * 12/2014 Amano ..... H01R 13/113 439/817
9,017,113 B2 * 4/2015 Haga ..... H01R 13/11 439/816
9,105,995 B2 * 8/2015 Tsuji ..... H01R 13/187
9,118,130 B1 * 8/2015 Volpone ..... H01R 13/113
9,515,396 B2 * 12/2016 Chikusa ..... H01R 4/48
2001/0051472 A1 * 12/2001 Sato ..... H01R 13/11 439/852
2004/0224573 A1 * 11/2004 Yoshida ..... H01R 13/11 439/852
2012/0289100 A1 * 11/2012 Ishida ..... H01R 13/113 439/858
2013/0288547 A1 * 10/2013 Amano ..... H01R 13/113 439/852
2014/0141662 A1 * 5/2014 Kutsuna ..... H01R 13/11 439/888
2014/0377991 A1 * 12/2014 Kawamura ..... H01R 4/183 439/604
2015/0087192 A1 * 3/2015 Tanigawa ..... H01R 4/18 439/852
2015/0207255 A1 7/2015 Sugiyama et al.
2018/0212340 A1 * 7/2018 Bhagyanathan-Sathlanathan ..... H01R 13/24

FOREIGN PATENT DOCUMENTS

JP 2006-172732 A 6/2006
WO 2018/021057 A1 2/2018

* cited by examiner

FEMALE TERMINAL WITH A PLURALITY OF SPRING MEMBERS AND A PROJECTING PORTION

CROSS REFERENCE TO RELATED APPLICATIONS

This application is a national phase of PCT application No. PCT/JP2019/037803, filed on 26 Sep. 2019, which claims priority from Japanese patent application No. 2018-187561, filed on 2 Oct. 2018, all of which are incorporated herein by reference.

TECHNICAL FIELD

A technique disclosed in this specification relates to a female terminal.

BACKGROUND

Conventionally, a female terminal is known which includes a terminal connecting portion, a male terminal being inserted into the terminal connecting portion, and resilient pieces disposed in the terminal connecting portion to resiliently contact the male terminal (see Patent Document 1). The resilient pieces are provided on both sides of the male terminal in a direction intersecting an entrance direction of the male terminal into the terminal connecting portion. These resilient pieces press the male terminal from both sides with respect to the entrance direction, whereby a movement of the male terminal in the direction intersecting the entrance direction of the male terminal is suppressed. In this way, the sliding wear of a part of the female terminal in contact with the male terminal is expected to be suppressed.

PRIOR ART DOCUMENT

Patent Document

Patent Document 1: JP 2014-072168 A

SUMMARY OF THE INVENTION

Problems to be Solved

However, according to the above configuration, there has been a concern that the sliding wear of the female terminal cannot be sufficiently suppressed. It is assumed that, with the male terminal inserted in the terminal connecting portion, the male terminal moves in the direction intersecting the entrance direction thereof and approaches one of the resilient pieces disposed on the both sides in the direction intersecting the entrance direction of the male terminal. Then, the one resilient piece pushes back the male terminal toward the other resilient piece by a resilient force thereof.

However, the other resilient piece still keeps applying a resilient force in a direction to promote the approach of the male terminal toward the one resilient piece to the male terminal. As a result, the resilient force of the one resilient piece is cancelled out by the resilient force of the other resilient piece, and it may not be possible to sufficiently suppress a movement of the male terminal in the direction intersecting the entrance direction thereof.

The technique disclosed in this specification was completed on the basis of the above situation and aims to suppress the sliding wear of a part of a female terminal in contact with a male terminal.

Means to Solve the Problem

The technique disclosed in this specification is directed to a female terminal with a terminal connecting portion extending along a length direction and including an insertion opening on a front end in the length direction, a male terminal being inserted into the insertion opening, a resilient contact piece disposed inside the terminal connecting portion and configured to sandwich the male terminal between the terminal connecting portion and the resilient contact piece by resiliently contacting the male terminal from a height direction intersecting the length direction, a plurality of spring members disposed side by side across a gap along the length direction inside the terminal connecting portion and configured to resiliently contact the male terminal from one side in a width direction intersecting the length direction and the height direction, and a projecting portion projecting from the other side in the width direction toward the one side in the width direction inside the terminal connecting portion and configured to sandwich the male terminal between the plurality of spring members and the projecting portion.

According to the above configuration, the male terminal comes into contact with the plurality of spring members disposed in the terminal connecting portion from the one side in the width direction. In this way, the male terminal is pressed against the projecting portion by receiving resilient forces along the width direction from the plurality of spring members. This suppresses a relative movement of the male terminal along the width direction. At this time, since the plurality of spring members press the male terminal from the one side in the width direction of the terminal connecting portion, no force to promote a movement of the male terminal is given. As a result, the sliding wear of a part of the female terminal in contact with the male terminal is suppressed.

Further, if the male terminal is going to rotate about an axis extending in the height direction, deflection amounts of the respective spring members are different since the plurality of spring members are disposed side by side across the gap along the length direction. Then, the male terminal receives a larger force from one of the plurality of spring members having the larger deflection amount. As a result, the relative rotation of the male terminal about the axis extending in the height direction is suppressed. As a result, the sliding wear of a part of the female terminal in contact with the male terminal is suppressed.

The following modes are preferable as embodiments of the technique disclosed in this specification.

The plurality of spring members are integrally formed to the terminal connecting portion.

According to the above configuration, the number of components can be reduced as compared to the case where the plurality of spring members are configured separately from the terminal connecting portion.

The plurality of spring members are members separate from the terminal connecting portion.

According to the above configuration, the plurality of spring members can be made of a material different from that of the terminal connecting portion and formed to have a thickness different from that of the terminal connecting portion. In this way, restrictions due to the shape of the terminal connecting portion, the material constituting the terminal connecting portion and the like can be reduced in designing the plurality of spring members. As a result, a degree of freedom in designing the plurality of spring members is improved.

The plurality of spring members include a front spring member located on a front side in the length direction and a rear spring member located on a rear side in the length direction.

According to the above configuration, if the male terminal is going to rotate about an axis extending in the height direction, a deflection amount of the front spring member and that of the rear spring member are different since the front and rear spring members are disposed side by side across the gap along the length direction, which is an extension direction of the terminal connecting portion. Then, the male terminal receives a larger force from one of the front and rear spring members having the larger deflection amount. As a result, the relative rotation of the male terminal about the axis extending in the height direction is suppressed.

A spring constant of the front spring member is set to be smaller than that of the rear spring member.

According to the above configuration, an insertion force when the male terminal enters the terminal connecting portion can be made smaller in an initial stage of a connecting operation of the male terminal and the female terminal. In this way, the efficiency of the connecting operation of the male terminal and the female terminal can be improved.

The front spring member is formed to extend forward in the length direction, and the rear spring member is formed to extend rearward in the length direction.

According to the above configuration, a large interval can be provided between a front end part of the front spring member and a rear end part of the rear spring member in the length direction. In this way, when the male terminal is going to relatively rotate about an axis extending in the height direction, an interval between the rotation axis and the front end part of the front spring member or the rear end part of the rear spring member can be made larger. As a result, the relative rotation of the male terminal about the axis extending in the height direction can be further suppressed.

Further, if one of the front and rear spring members is pressed from the male terminal, the front and rear spring members act like a seesaw as a whole and the male terminal can be pressed such that the other spring member assists the one spring member. In this way, the relative rotation of the male terminal about the axis extending in the height direction can be further suppressed.

One or both of the front and rear spring members is/are formed to extend in the height direction.

According to the above configuration, even if the terminal connecting portion does not have a sufficient length in the length direction, one or both of the front and rear spring members can be formed to extend in the height direction of the terminal connecting portion, wherefore a degree of freedom in designing the female terminal can be improved.

The front spring member includes a front pressing portion configured to contact the male terminal, the rear spring member includes a rear pressing portion configured to contact the male terminal, the projecting portion is formed to extend along the length direction, and a front end part of the projecting portion is located forward of the front pressing portion of the front spring member and a rear end part of the projecting portion is located rearward of the rear pressing portion of the rear spring member in the length direction.

According to the above configuration, a large interval between the rotation axis and the front pressing portion of the front spring member and a large interval between the rotation axis and the rear pressing portion of the rear spring member can be set in the length direction. In this way, the relative rotation of the male terminal about the axis extending in the height direction can be further suppressed.

The front spring member includes a front pressing portion configured to contact the male terminal, the rear spring member includes a rear pressing portion configured to contact the male terminal, and the resilient contact piece includes a contact protrusion configured to be located between the front and rear pressing portions in the length direction and contact the male terminal.

According to the above configuration, the male terminal successively contacts the front pressing portion of the front spring member, the contact protrusion of the resilient contact piece and the rear pressing portion of the rear spring member in an insertion process of the male terminal. Since an insertion force of the male terminal is dispersed in this way, a maximum insertion force of the male terminal can be reduced.

Effect of the Invention

According to the technique disclosed in this specification, it is possible to suppress the sliding wear of a part of the female terminal held in contact with the male terminal.

DETAILED DESCRIPTION TO EXECUTE THE INVENTION

First Embodiment

A first embodiment of the technique disclosed in this specification is described with reference to FIGS. 1 to 15. A female terminal 10 according to this embodiment is connected to a male terminal 11. Note that, in the following description, a Z-axis direction is a height direction, a Y-axis is a length direction and an X-axis direction is a width direction. The height, length and width directions intersect (are orthogonal to) each other. A direction indicated by an arrow of a Z axis is an upward direction concerning the height direction, a direction indicated by an arrow of a Y axis is a forward direction concerning the length direction and a direction indicated by an arrow of an X axis is a leftward direction concerning the width direction. Further, only some of a plurality of identical members may be denoted by a reference sign and the other thereof may not be denoted by the reference sign.

(Male Terminal 11)

Figure 7:
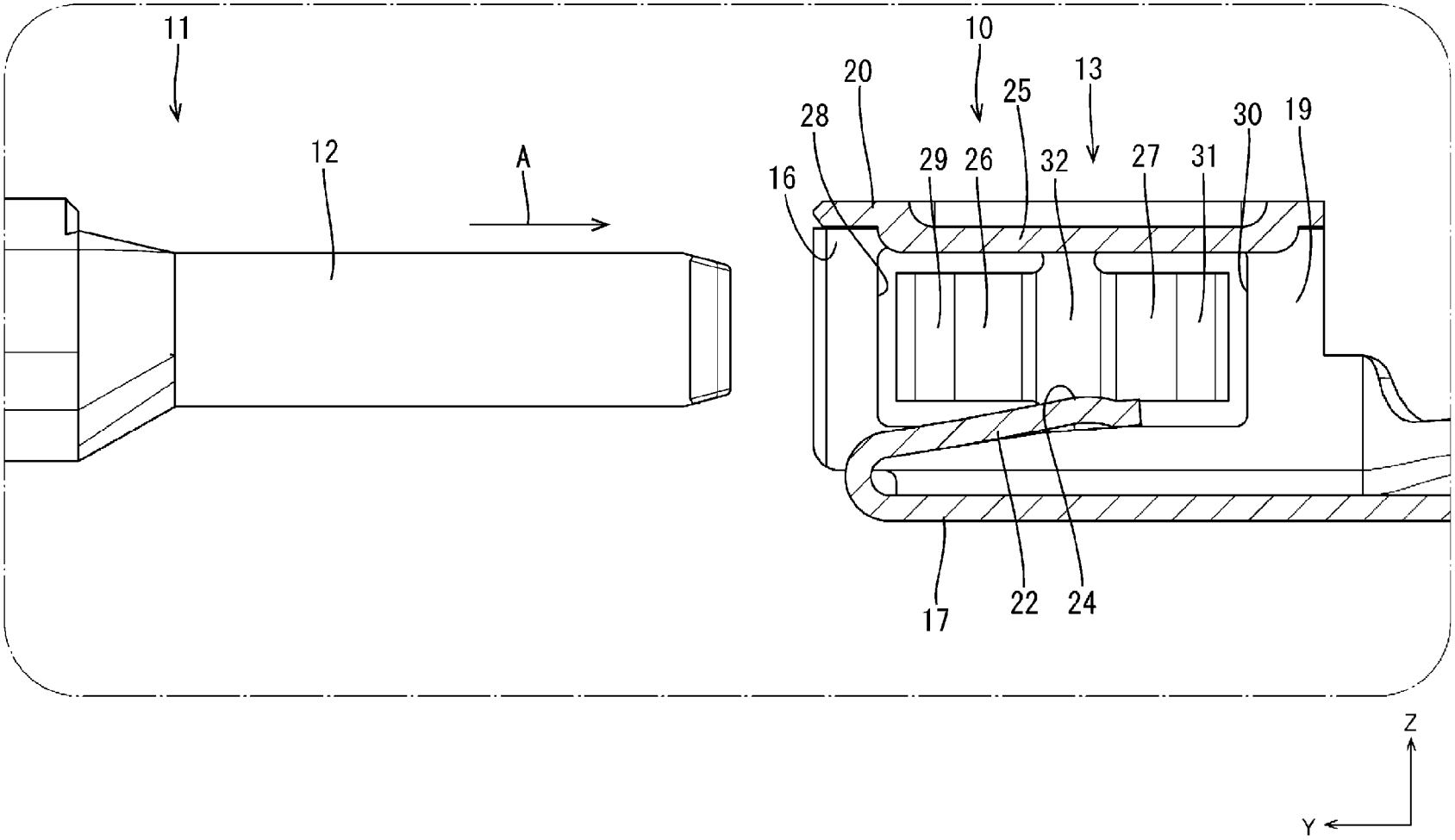
FIG. 7 is a side view partly in section showing a male terminal and the female terminal.
Figure 8:
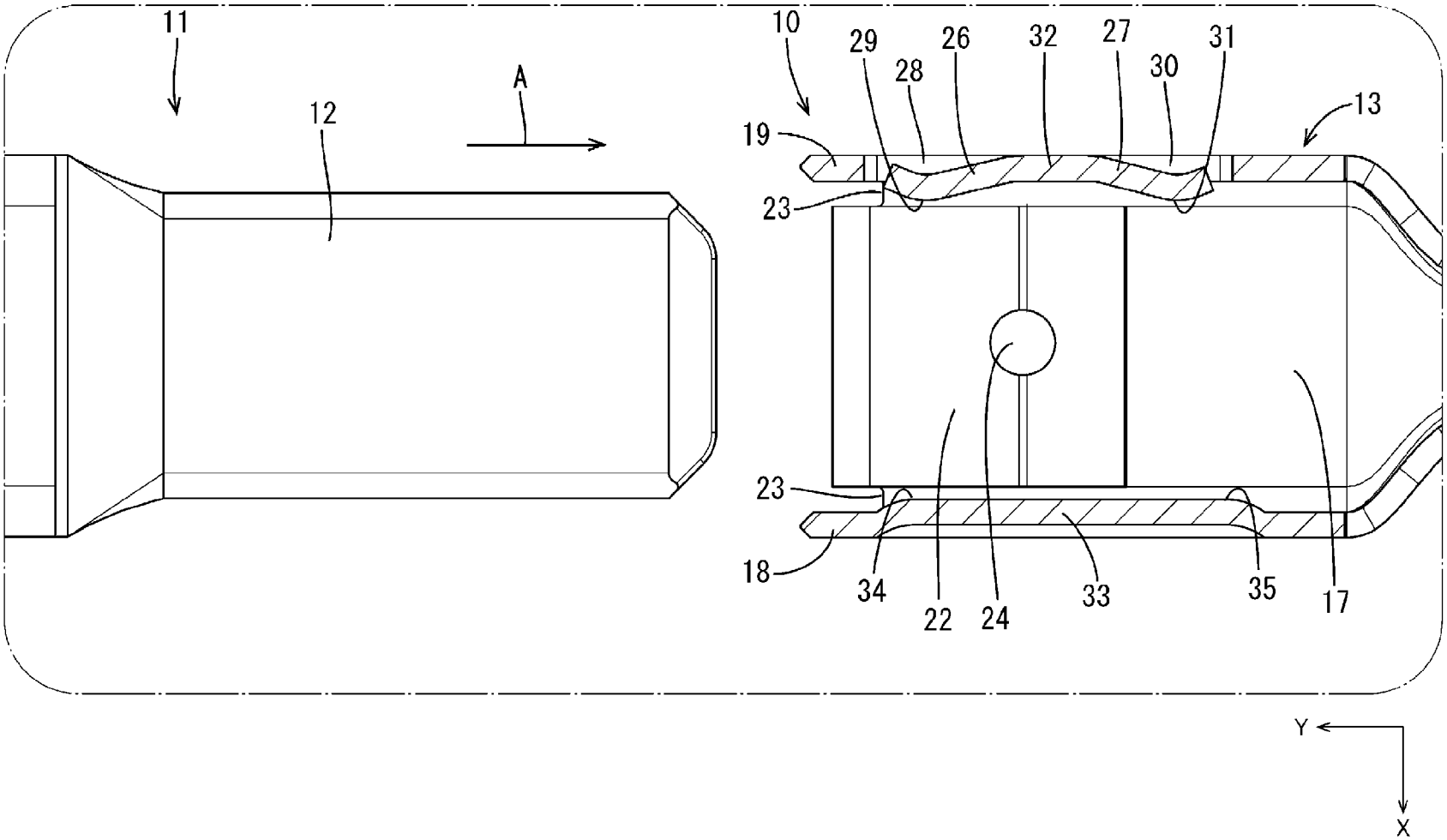
FIG. 8 is a plan view partly in section showing the male terminal and the female terminal.
Figure 9:
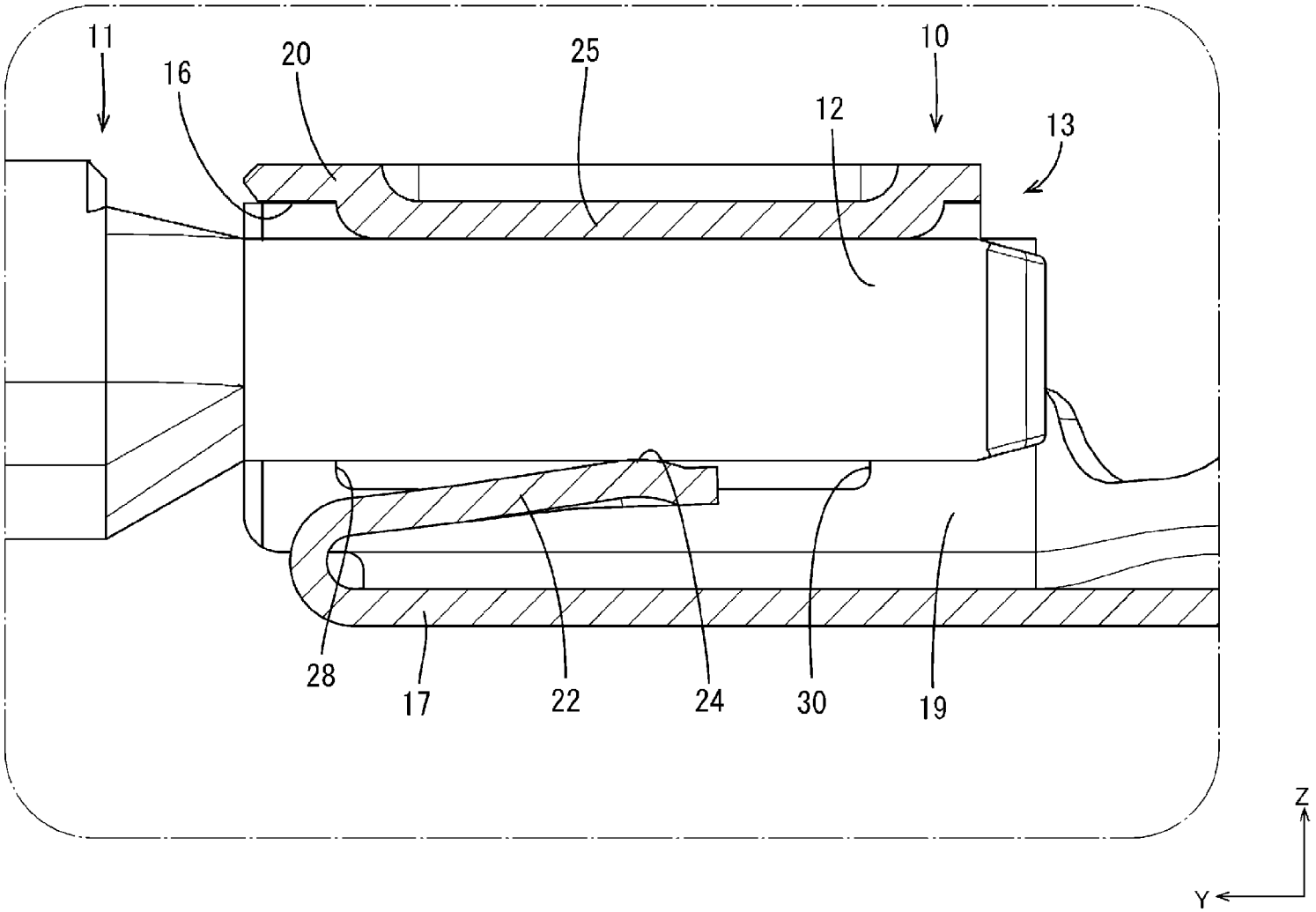
FIG. 9 is a side view partly in section showing a state where the male terminal and the female terminal are connected.
Figure 10:
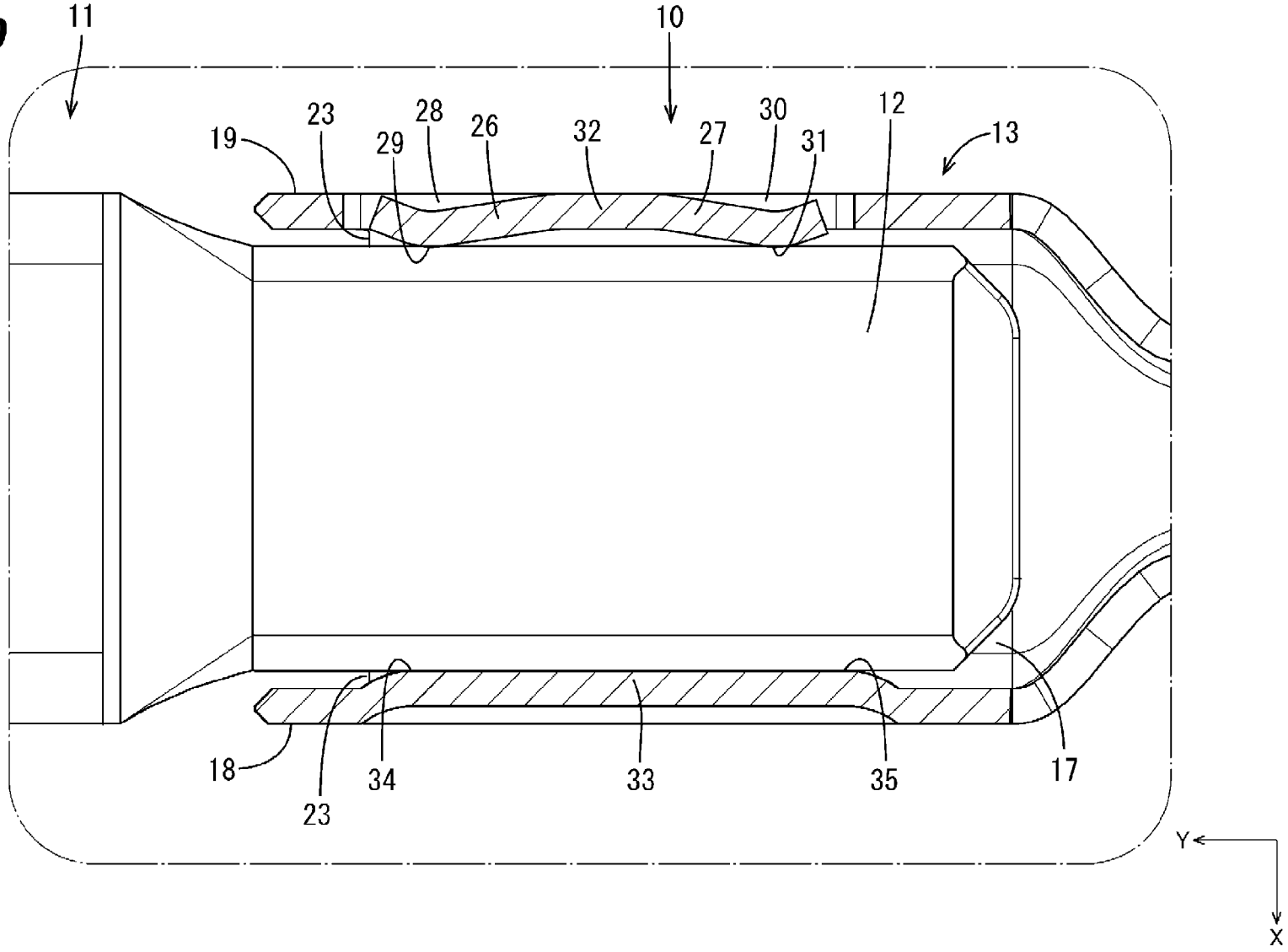
FIG. 10 is a plan view partly in section showing the state where the male terminal and the female terminal are connected.

As shown in FIGS. 7 and 8, the male terminal 11 is formed by press-working a conductive metal plate material into a predetermined shape. The male terminal 11 includes a male tab 12 in the form of a flat plate. The male terminal 11 may be connected to an unillustrated wire or may be connected to an unillustrated device. The male tab 12 is formed to have a substantially constant width along the length direction and has a substantially rectangular shape when viewed from above (see FIG. 8). A tip part of the male terminal 12 is formed into a slightly tapered shape. An arbitrary metal such as copper, copper alloy, aluminum or aluminum alloy can be appropriately selected according to need as a metal constituting the male terminal 11. In this embodiment, copper or copper alloy is used.

(Female Terminal 10)

Figure 1:
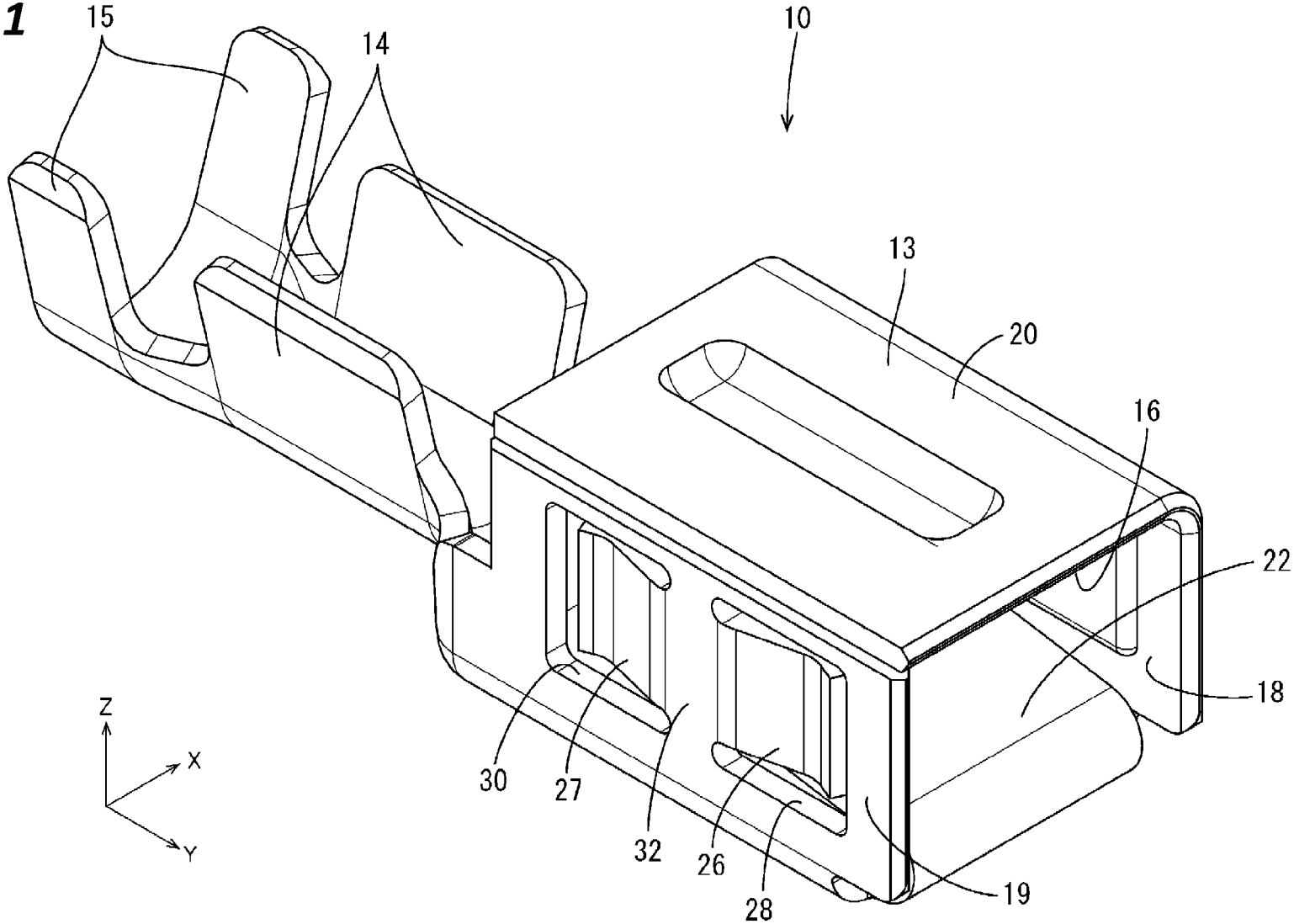
FIG. 1 is a perspective view showing a female terminal according to a first embodiment.
Figure 2:
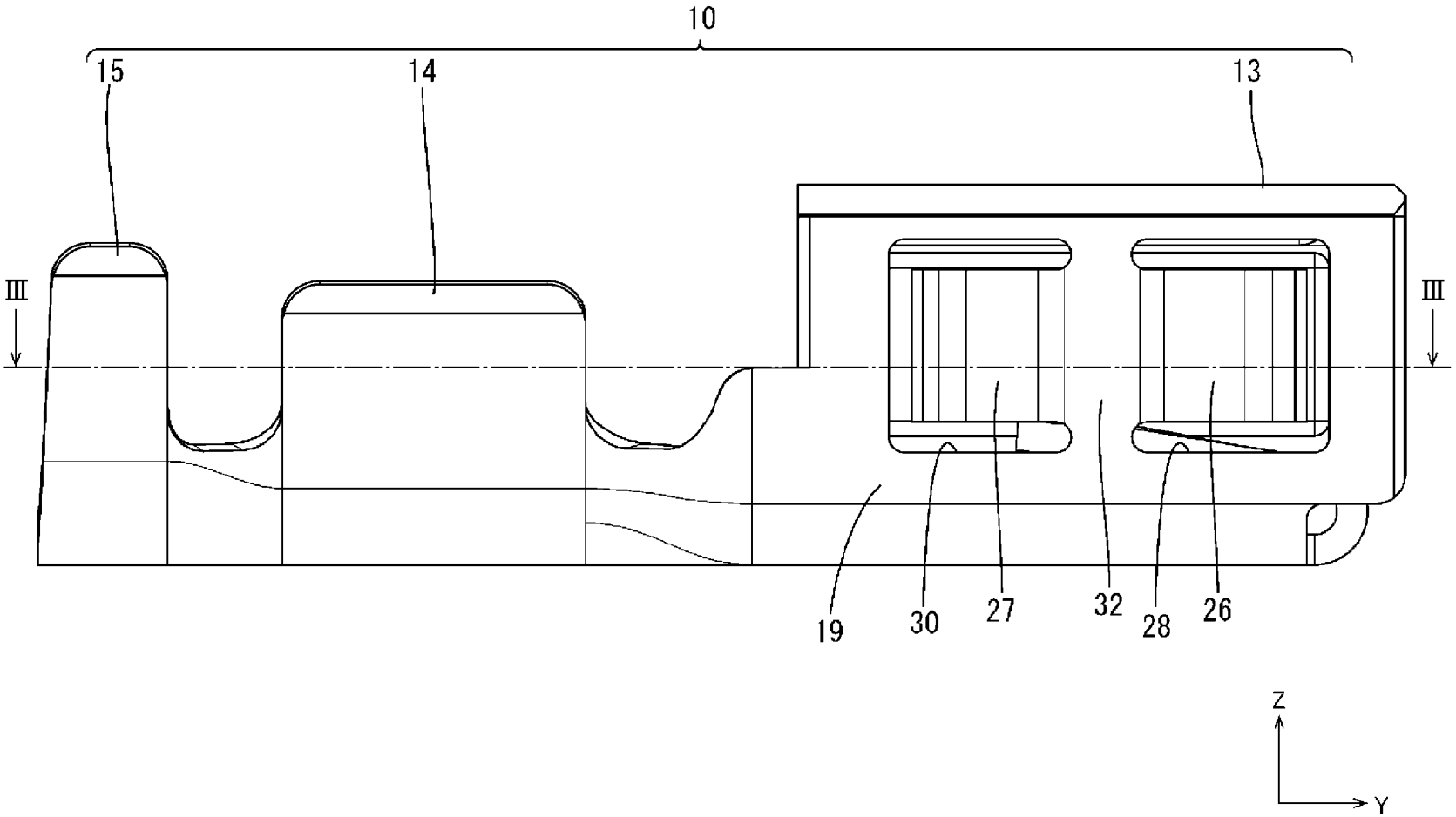
FIG. 2 is a side view showing the female terminal.

As shown in FIGS. 1 and 2, the female terminal 10 includes a tubular terminal connecting portion 13 into which the male tab 12 of the male terminal 11 is to be inserted, a wire barrel 14 connected to the terminal connecting portion 13 and to be crimped to the outer periphery of a core (not shown) exposed from an end of a wire (not shown), and an insulation barrel 15 connected to the wire barrel 14 and to be crimped to the outer periphery of an insulation coating (not shown) covering the core of the wire. The female terminal 10 is formed by press-working a conductive metal plate material into a predetermined shape. An arbitrary metal such as copper, copper alloy, aluminum or aluminum alloy can be appropriately selected according to need as a metal constituting the female terminal 10. In this embodiment, copper or copper alloy is used.

(Terminal Connecting Portion 13)

Figure 6:
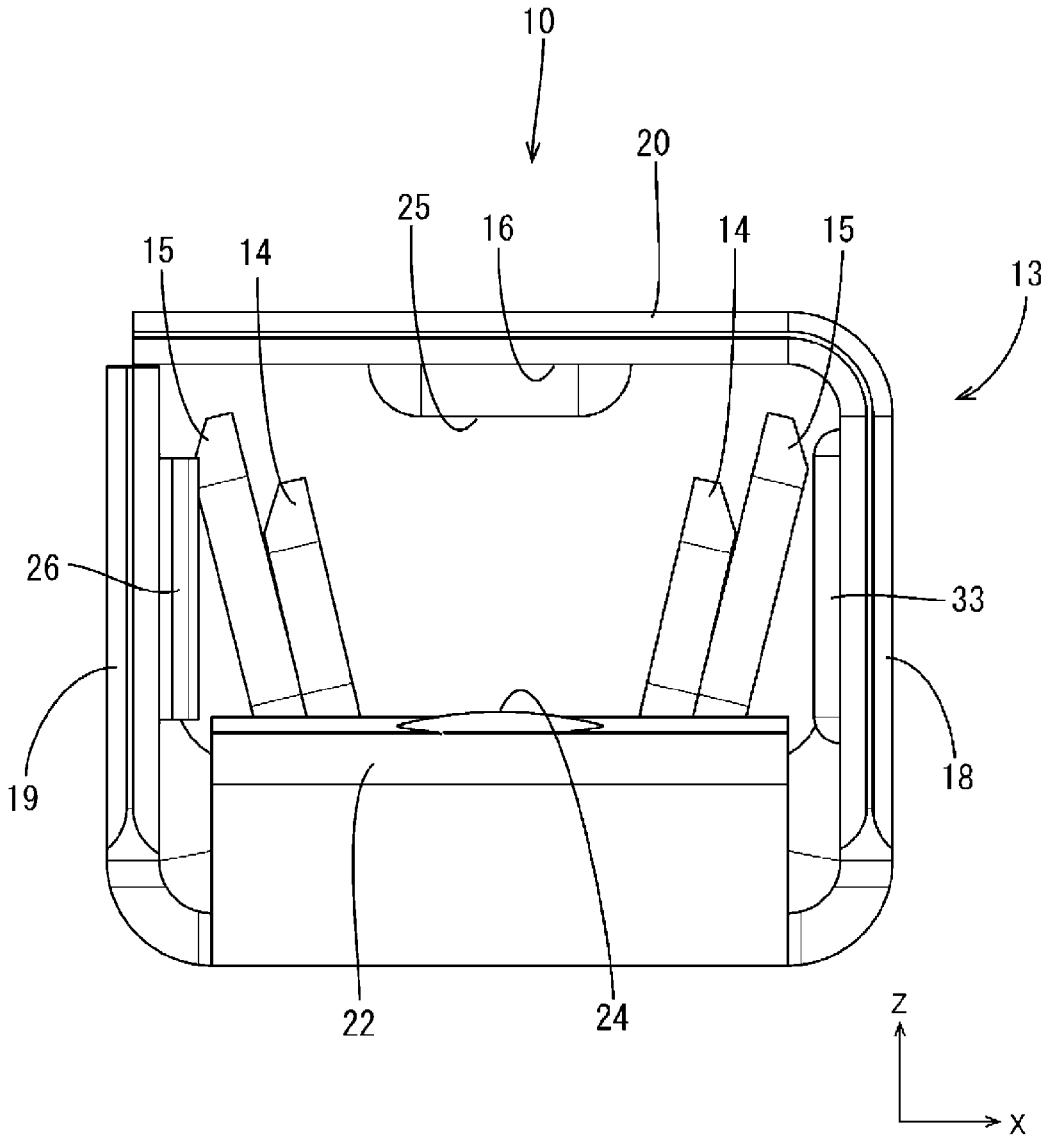
FIG. 6 is a front view showing the female terminal.

As shown in FIG. 1, the terminal connecting portion 13 is in the form of a rectangular tube extending in the length direction. An insertion opening 16 into which the male terminal 11 is to be inserted is open forward in a front end part in the length direction of the terminal connecting portion 13. As shown in FIG. 6, the insertion opening 16 has a substantially rectangular shape when viewed from front.

The terminal connecting portion 13 includes a bottom wall 17, a left side wall 18 rising upward from the left side edge of the bottom wall 17, a right side wall 19 rising upward from the right side edge of the bottom wall 17 and an upper wall 20 extending rightward from the upper edge of the left side wall 18.

(Resilient Contact Piece 22)

Figure 5:
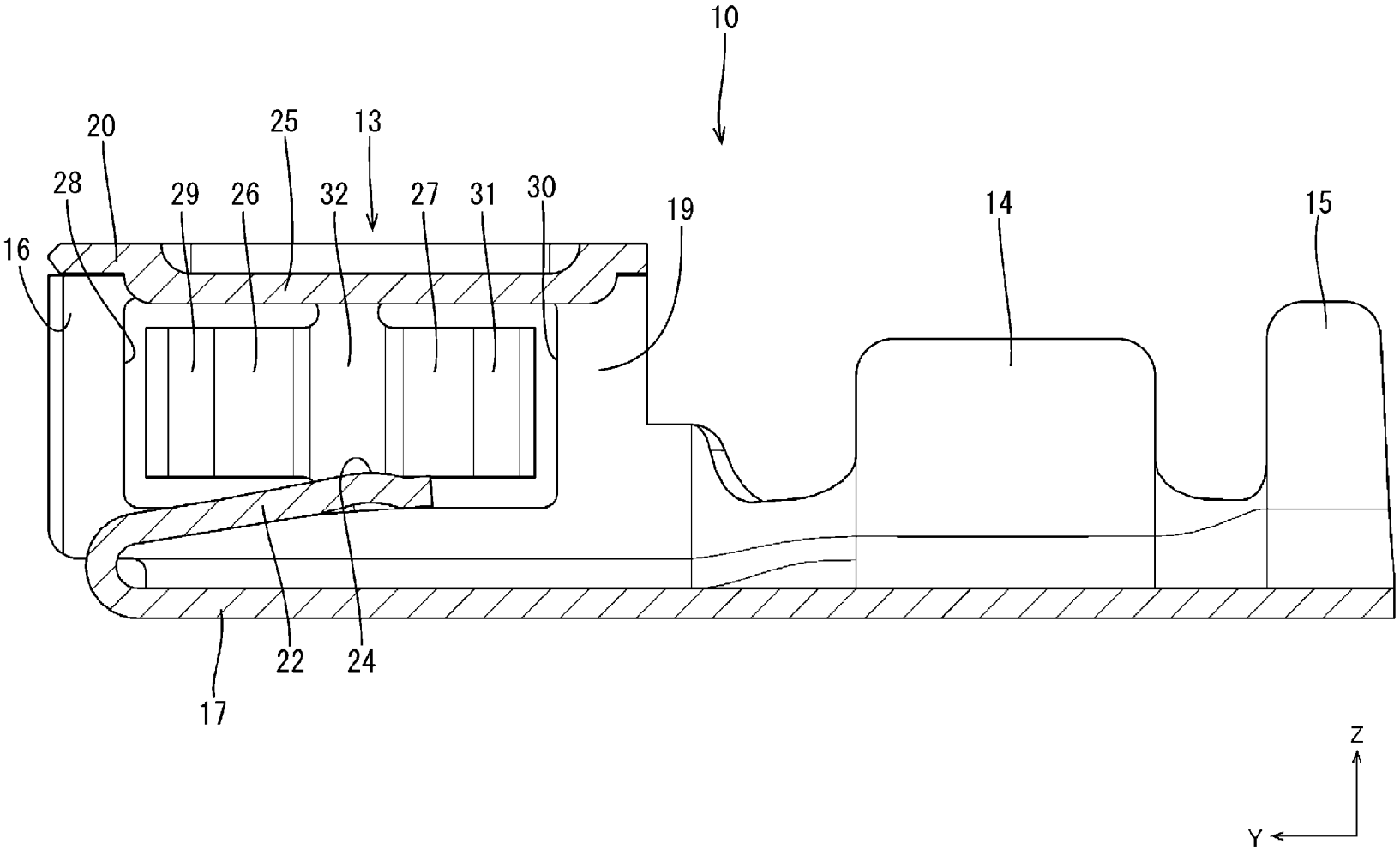
FIG. 5 is a side view in section of the female terminal.

As shown in FIG. 5, a resilient contact piece 22 folded rearward extends from the front end edge of the bottom wall 17 of the terminal connecting portion 13. The resilient contact piece 22 is cantilevered to an oblique upper-rear side in the terminal connecting portion 13. In other words, the resilient contact piece 22 is inclined to come closer to the upper wall 20 toward a rear side. A width of the resilient contact piece 22 according to this embodiment is set to be constant along the length direction.

Figure 3:
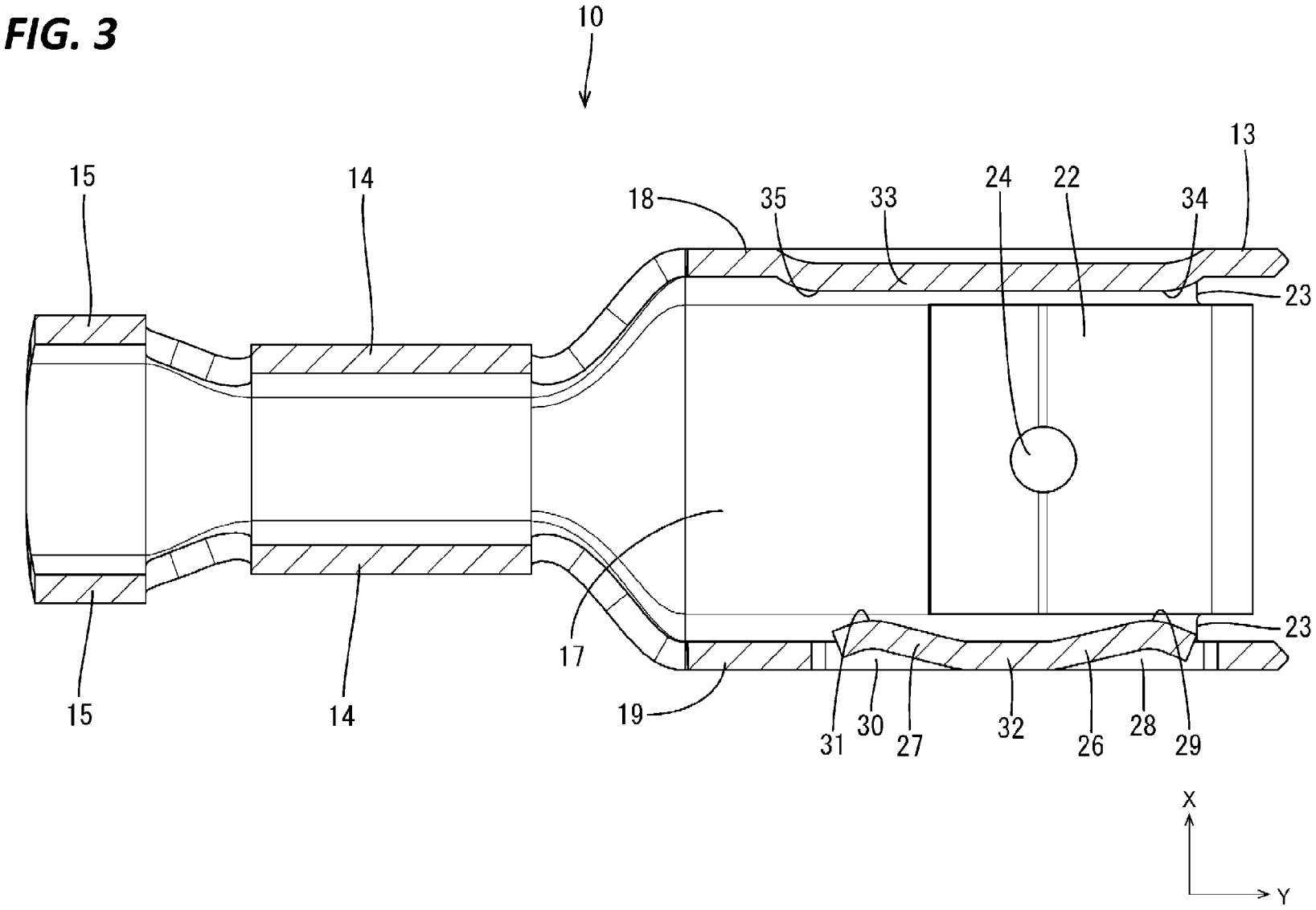
FIG. 3 is a section along in FIG. 2.

As shown in FIG. 3, cutouts 23 extending rearward are provided at positions outward of the resilient contact piece 22 in the width direction on the front end edge of the bottom wall 17 of the terminal connecting portion 13. Even if the resilient contact piece 22 is resiliently deformed, these cutouts 22 make the bottom wall 17 less affected by this deformation.

Figure 4:
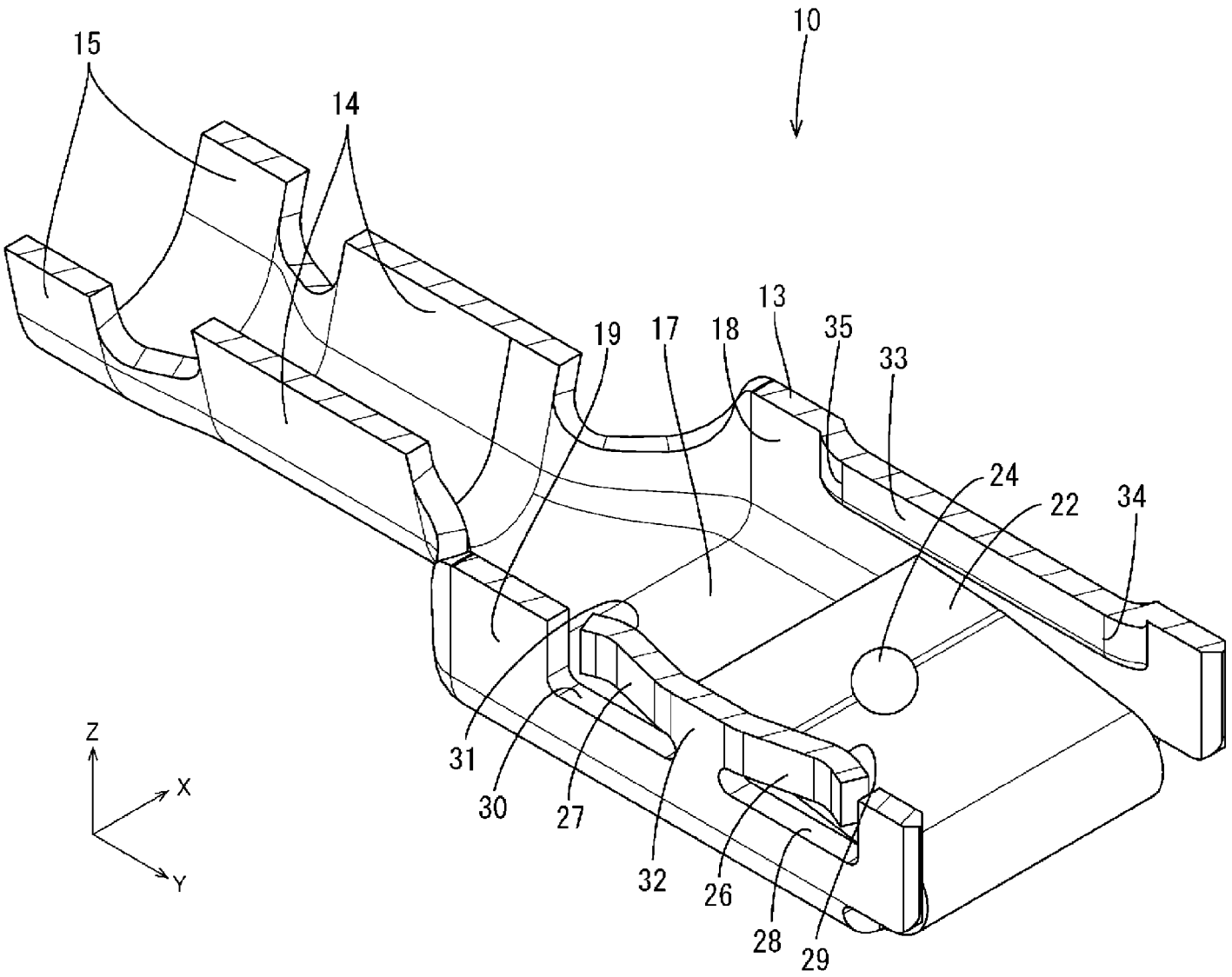
FIG. 4 is a perspective view showing a cross-section cut along in FIG. 2 viewed from an angle different from in FIG. 3.

As shown in FIGS. 3 to 5, a contact protrusion 24 projecting upward is formed near a widthwise center at a position near a rear end part of the resilient contact piece 22. The contact protrusion 24 is formed by striking and has a circular shape when viewed from above.

(Rib 25)

As shown in FIGS. 5 and 6, a rib 25 extending in a front-rear direction is formed by striking the upper wall 20 of the terminal connecting portion 13 downward. The rib 25 has a substantially semi-elliptical cross-sectional shape. An interval between the lower end of the rib 25 and the upper end of the contact protrusion 24 in a state where the resilient contact piece 22 is not resiliently deformed is set to be smaller than a thickness of the male terminal 11. The upper end of the contact protrusion 24 is disposed at a position somewhat behind a lengthwise center position of the rib 25 in the length direction.

(Spring Members (Front Spring Member 26, Rear Spring Member 27))

As shown in FIG. 3, a front spring member 26 located on a front side and a rear spring member 27 located on a rear side in the length direction are provided side by side across a gap in the length direction in the right side wall 19 of the terminal connecting portion 13.

As shown in FIG. 2, a substantially U-shaped front slit 28 is formed at a front position in the length direction in the right side wall 19 of the terminal connecting portion 13. The front spring member 26 is formed by cutting a region surrounded by the front slit 28 and raising the cut region inwardly of the terminal connecting portion 13. The front spring member 26 is in the form of a leaf spring extending forward from the vicinity of a lengthwise center position of the right side wall 19 of the terminal connecting portion 13. The front spring member 26 is resiliently deformed outward (rightward) in the width direction with a base end as a fulcrum. A front end part of the front spring member 26 is a free end. As shown in FIGS. 3 and 4, the front end part of the front spring member 26 is bent outward (rightward) in the width direction. Out of the front spring member 26, a part located on an innermost side in the width direction serves as a front pressing portion 29.

As shown in FIG. 2, a substantially U-shaped rear slit 30 is formed at a rear position in the length direction in the right side wall 19 of the terminal connecting portion 13. The rear spring member 27 is formed by cutting a region surrounded by the rear slit 30 and raising the cut region inwardly of the terminal connecting portion 13. The rear spring member 27 is in the form of a leaf spring extending rearward from the vicinity of the lengthwise center position of the right side wall 19 of the terminal connecting portion 13. The rear spring member 27 is resiliently deformed outward (rightward) in the width direction with a base end as a fulcrum. A rear end part of the rear spring member 27 is a free end. As shown in FIGS. 3 and 4, the rear end part of the rear spring member 27 is bent outward (rightward) in the width direction. Out of the rear spring member 27, a part located on an innermost side in the width direction serves as a rear pressing portion 31.

As shown in FIG. 5, a height of the front spring member 26 and that of the rear spring member 27 are set to be equal in the height direction. On the other hand, a length of the front spring member 26 is set to be larger than that of the rear spring member 27 in the length direction. In this way, a spring constant of the front spring member is set to be smaller than that of the rear spring member 27.

As shown in FIG. 5, the front pressing portion 29 of the front spring member 26, the contact protrusion 24 of the resilient contact piece 22 and the rear pressing portion 31 of the rear spring member 27 are disposed at positions shifted in the length direction. In particular, the front pressing portion 29 of the front spring member 26 is located at the most forward position, the contact protrusion 24 of the resilient contact piece 22 is located at the next position and the rear pressing portion 31 of the rear spring member 27 is located at the most rearward position in the length direction.

The upper edge of the front spring member 26 and that of the rear spring member 27 are located somewhat below the lower end of the rib 25. Further, the lower edge of the front spring member 26 and that of the rear spring member 27 are located somewhat below the upper end of the contact protrusion 24 of the resilient contact piece 22 in a state not resiliently deformed. In this way, the front and rear spring members 26, 27 are located to the right of the male tab 12 in a state where the male tab 12 of the male terminal 11 is inserted in the terminal connecting portion 13 and the resilient contact piece 22 is resiliently deformed downward by the male tab 12. By the above configuration, the front and rear spring members 26, 27 resiliently contact the male tab 12 of the male terminal 11 from a right side in the width direction (equivalent to one side in the width direction).

Out of the right side wall 19 of the terminal connecting portion 13, a part located between the front slit 28 and the rear slit 30 serves as a support wall 32. The strength of the right side wall 19 of the terminal connecting portion 13 in the height direction is held by this support wall 32.

(Projecting Portion 33)

As shown in FIGS. 3 and 4, a projecting portion 33 projects rightward in the width direction (equivalent to one side in the width direction) from a left side in the width direction (equivalent to the other side in the width direction) inside the terminal connecting portion 13. In other words, the projecting portion 33 is formed to project toward the front and rear spring members 26, 27 by striking the left side wall 18 of the terminal connecting portion 13. This projecting portion 33 is formed to extend in the length direction in the left side wall 18 of the terminal connecting portion 13. The projecting portion 33 is provided at a height position corresponding to the front and rear spring members 26, 27 in the height direction. In a state where the male tab 12 is not inserted inside the terminal connecting portion 13, the front and rear spring members 26, 27 and the projecting portion 33 are disposed at positions facing each other. The projecting portion 33 has a semi-elliptical cross-sectional shape flat in the width direction.

As shown in FIG. 3, a front end part 34 of the projecting portion 33 is located forward of the front projecting portion 29 of the front spring member 26 and a rear end part 35 of the projecting portion 33 is located rearward of the rear pressing portion 31 of the rear spring member 27 in the length direction.

Figure 11:
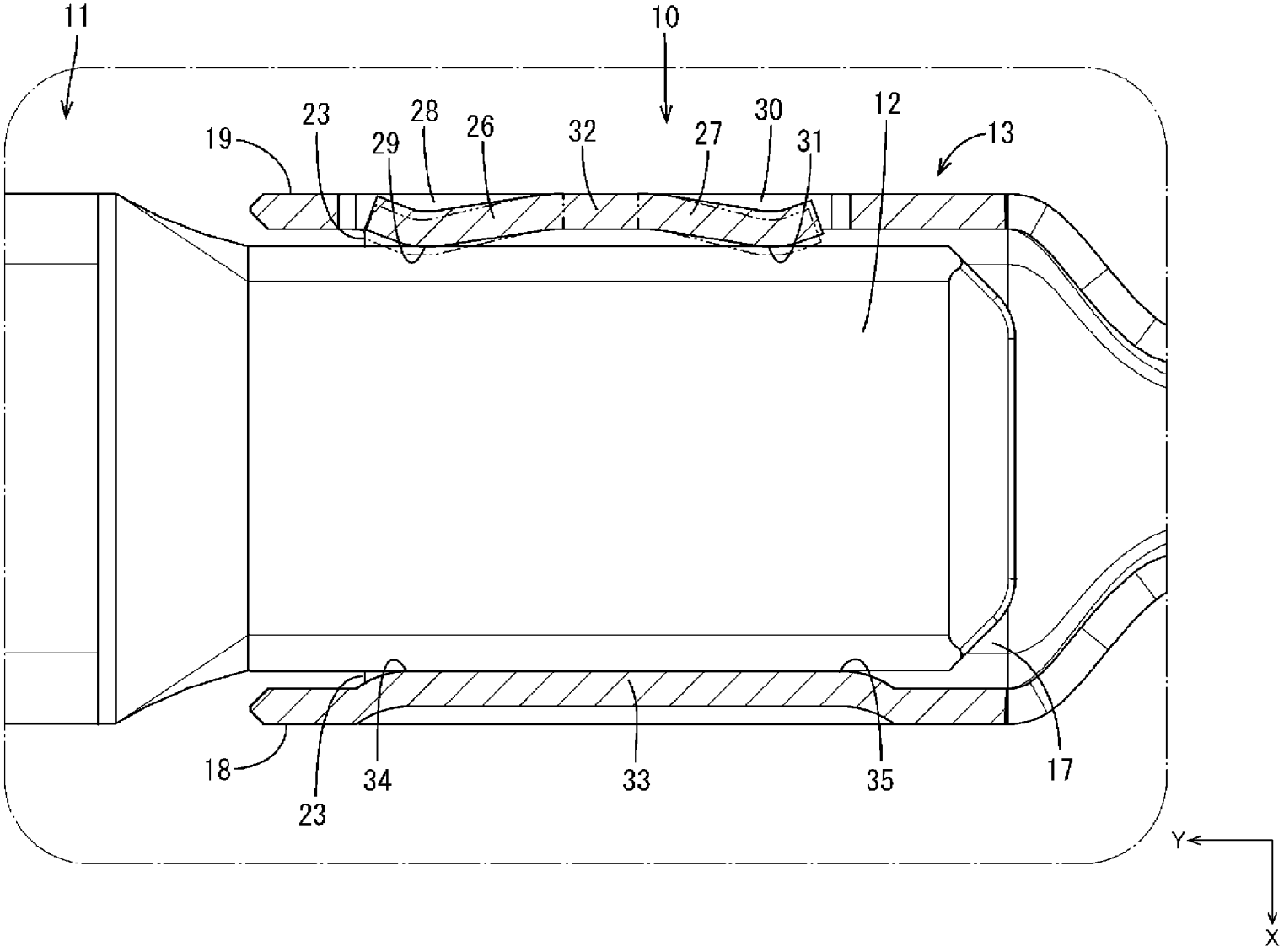
FIG. 11 is a plan view partly in section showing deflection amounts of a front spring member and a rear spring member.

As shown in a chain double-dashed line in FIG. 11, an interval in the width direction between the front pressing portion 29 of the front spring member 26 in a state not resiliently deformed and the projecting portion 33 is set to be smaller than a width of the male tab 12 of the male terminal 11. Further, an interval in the width direction between the rear pressing portion 31 of the rear spring member 27 in a state not resiliently deformed and the projecting portion 33 is set to be smaller than the width of the male tab 12 of the male terminal 11.

(Functions and Effects of Embodiment)

Next, functions and effects of this embodiment are described. As shown by an arrow line A in FIGS. 7 and 8, the male tab 12 of the male terminal 11 is inserted into the insertion opening 16 of the terminal connecting portion 13 of the female terminal 10 from front. Then, a tip part of the right side edge of the male tab 12 comes into contact with the front pressing portion 29 of the front spring member 26 from a left side. In this way, the front spring member 26 is resiliently deformed outward (rightward) in the width direction. As a result, the male terminal 11 is pressed leftward in the width direction toward the projecting portion 33 by a resilient force of the front spring member 26. In this way, the male terminal 11 is sandwiched in the width direction by the front spring member 26 and the projecting portion 33. As a result, a movement of the male terminal 11 in the width direction is suppressed.

If the male terminal 11 is pushed further rearward, a tip part of the lower surface of the male tab 12 comes into contact with the contact protrusion 24 of the resilient contact piece 22 from above. Then, the resilient contact piece 22 is resiliently deformed upward. In this way, the resilient contact piece 22 presses the male tab 12 in the height direction from below. As a result, the male tab 12 is sandwiched in a vertical direction by the resilient contact piece 22 and the rib 25. As a result, the male terminal 11 and the female terminal 10 are electrically connected (see FIG. 9).

If the male terminal 11 is pushed further rearward, the tip part of the right side edge of the male tab 12 comes into contact with the rear pressing portion 31 of the rear spring member 27 from the left side. Then, the rear spring member 27 is resiliently deformed outward (rightward) in the width direction. As a result, the male terminal 11 is pressed leftward in the width direction toward the projecting portion 33 by a resilient force of the rear spring member 27. In this way, the male terminal 11 is sandwiched in the width direction by the rear spring member 27 and the projecting portion 33. As a result, a relative movement of the male terminal 11 in the width direction with respect to the female terminal 10 is suppressed (see FIG. 10). Note that relative movements of the male terminal 11 with respect to the female terminal 10 include a movement of the male terminal 11 without the female terminal 10 moving, a movement of the female terminal 10 without the male terminal 11 moving and movements of both the male terminal 11 and the female terminal 10.

According to this embodiment, the right side edge of the male tab 12 of the male terminal 11 comes into contact with the front and rear spring members 26, 27 disposed in the terminal connecting portion 13 from the left side in the width direction. In this way, the male tab 12 is pushed leftward in the width direction to be pressed against the projecting portion 33 by receiving resilient forces along the width direction from the front and rear spring members 26, 27. In this way, a movement of the male terminal 11 along the width direction is suppressed. At this time, since a plurality of the spring members press the male terminal 11 from the right side in the width direction in the terminal connecting portion 13, no force in a direction to promote a movement of the male terminal 11 is given. As a result, the sliding wear of a part of the female terminal 10 in contact with the male terminal 11 is suppressed.

Further, when the male terminal 11 is going to relatively rotate about an axis extending in the height direction, the deflection amounts of the front and rear spring members 26, 27 are different since the front and rear spring members 26, 27 are disposed side by side across the gap in the length direction. Then, the male terminal 11 receives a larger force from the spring member having the larger deflection amount, out of the front and rear spring members 26, 27. As a result, the rotation of the male terminal 11 about the axis extending in the height direction is suppressed. As a result, the sliding wear of a part of the female terminal 10 in contact with the male terminal 11 is suppressed. Note that the relative rotation of the male terminal 11 includes the rotation of the male terminal 11 without the female terminal 10 rotating, the rotation of the female terminal 10 without the male terminal 11 rotating and the rotation of both the male and female terminals 11, 10.

Further, according to this embodiment, the front and rear spring members 26, 27 are integrally formed to the terminal connecting portion 13. In this way, the number of components can be reduced as compared to the case where the front and rear spring members 26, 27 are configured separately from the terminal connecting portion 13.

Further, according to this embodiment, the spring constant of the front spring member 26 is set to be smaller than that of the rear spring member 27.

According to the above configuration, an insertion force when the male terminal 11 enters the terminal connecting portion 13 can be made smaller in an initial stage of a connecting operation of the male terminal 11 and the female terminal 10. In this way, the efficiency of the connecting operation of the male terminal 11 and the female terminal 10 can be improved.

Further, according to this embodiment, the front spring member 26 is formed to extend forward in the length direction, and the rear spring member 27 is formed to extend rearward in the length direction.

According to the above configuration, a large interval can be provided between the front end part of the front spring member 26 and the rear end part of the rear spring member 27 in the length direction. In this way, when the male terminal 11 is going to relatively rotate about an axis extending in the height direction, an interval between the rotation axis and the front end part of the front spring member 26 or the rear end part of the rear spring member 27 can be made larger. As a result, the relative rotation of the male terminal 11 about the axis extending in the height direction can be further suppressed.

Further, if one of the front and rear spring members 26, 27 is pressed from the male terminal 11, the front and rear spring members 26, 27 act like a seesaw as a whole and the male terminal 11 can be pressed such that the other spring member assists the one spring member. In this way, the relative rotation of the male terminal 11 about the axis extending in the height direction can be further suppressed.

Further, according to this embodiment, the front spring member 26 includes the front pressing portion 29 configured to contact the male terminal 11, the rear spring member 27 includes the rear pressing portion 31 configured to contact the male terminal 11, the projecting portion 33 is formed to extend along the length direction, and the front end part 34 of the projecting portion 33 is located forward of the front pressing portion 29 of the front spring member 26 and the rear end part 35 of the projecting portion 33 is located rearward of the rear pressing portion 31 of the rear spring member 27 in the length direction.

According to the above configuration, it is possible to set a large interval between the rotation axis and the front pressing portion 29 of the front spring member 26 and a large interval between the rotation axis and the rear pressing portion 31 of the rear spring member 27. In this way, the relative rotation of the male terminal 11 about the axis extending in the height direction can be further suppressed. This is described in detail below.

Figure 12:
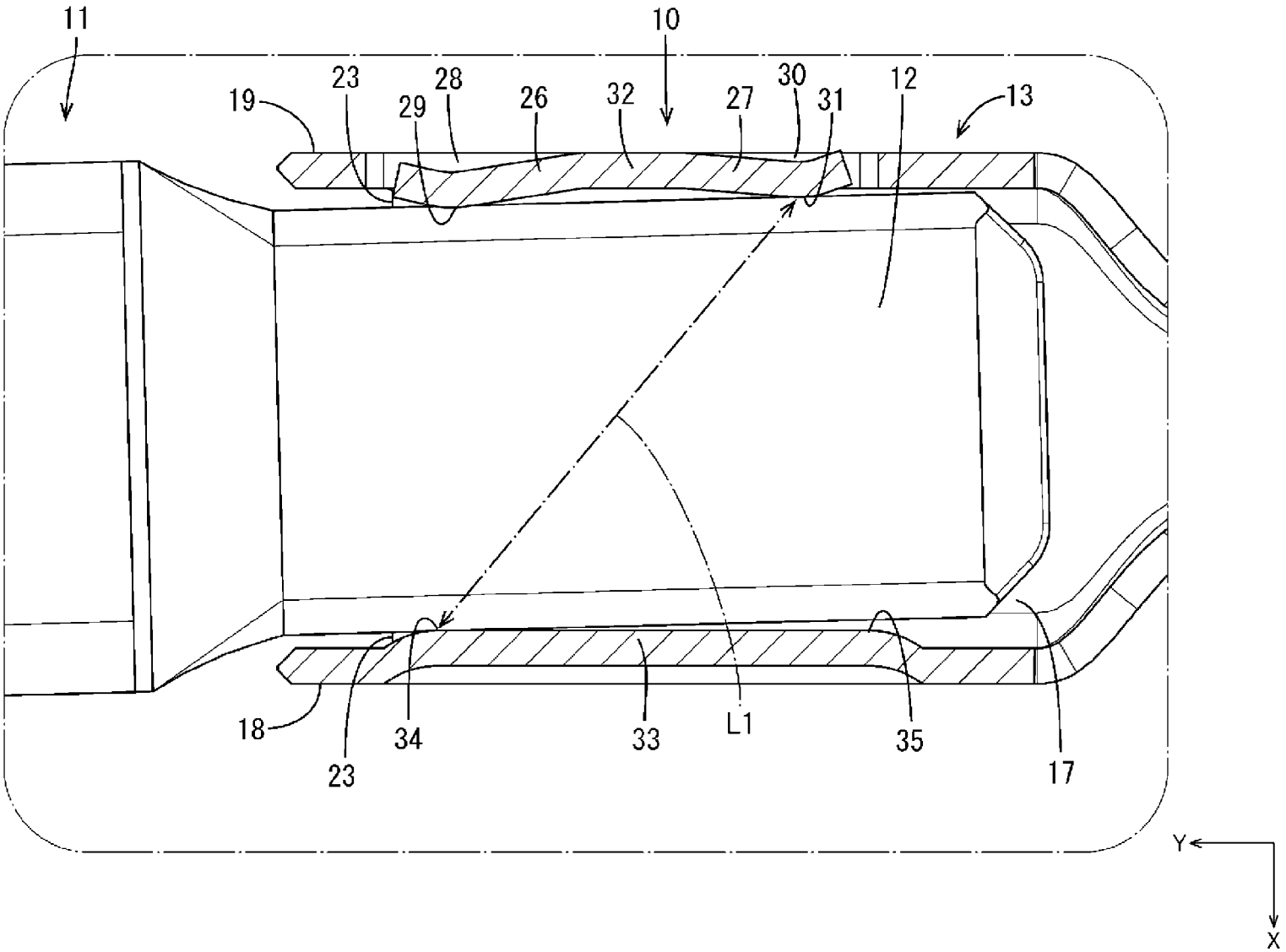
FIG. 12 is a plan view partly in section showing a state where the male terminal relatively rotates about a front end part of a projecting portion as a center of rotation.

If the male tab 12 is going to relatively rotate about an axis extending in the height direction with the front end part 34 of the projecting portion 33 as a center of rotation as shown in FIG. 12, the rear pressing portion 31 of the rear spring member 27 tries to suppress the rotation of the male tab 12 by pressing the right side edge of the male tab 12 leftward and functioning as a fulcrum. In this embodiment, an interval L1 between the front end part 34 of the projecting portion 33 serving as the center of rotation of the male tab 12 and the rear pressing portion 31 of the rear spring member 27 functioning as the fulcrum to suppress the rotation of the male tab 12 is set to be relatively large. In this way, the interval between the center of rotation and the fulcrum can be set to be relatively larger, wherefore the relative rotation of the male tab 12 can be effectively suppressed.

Figure 13:
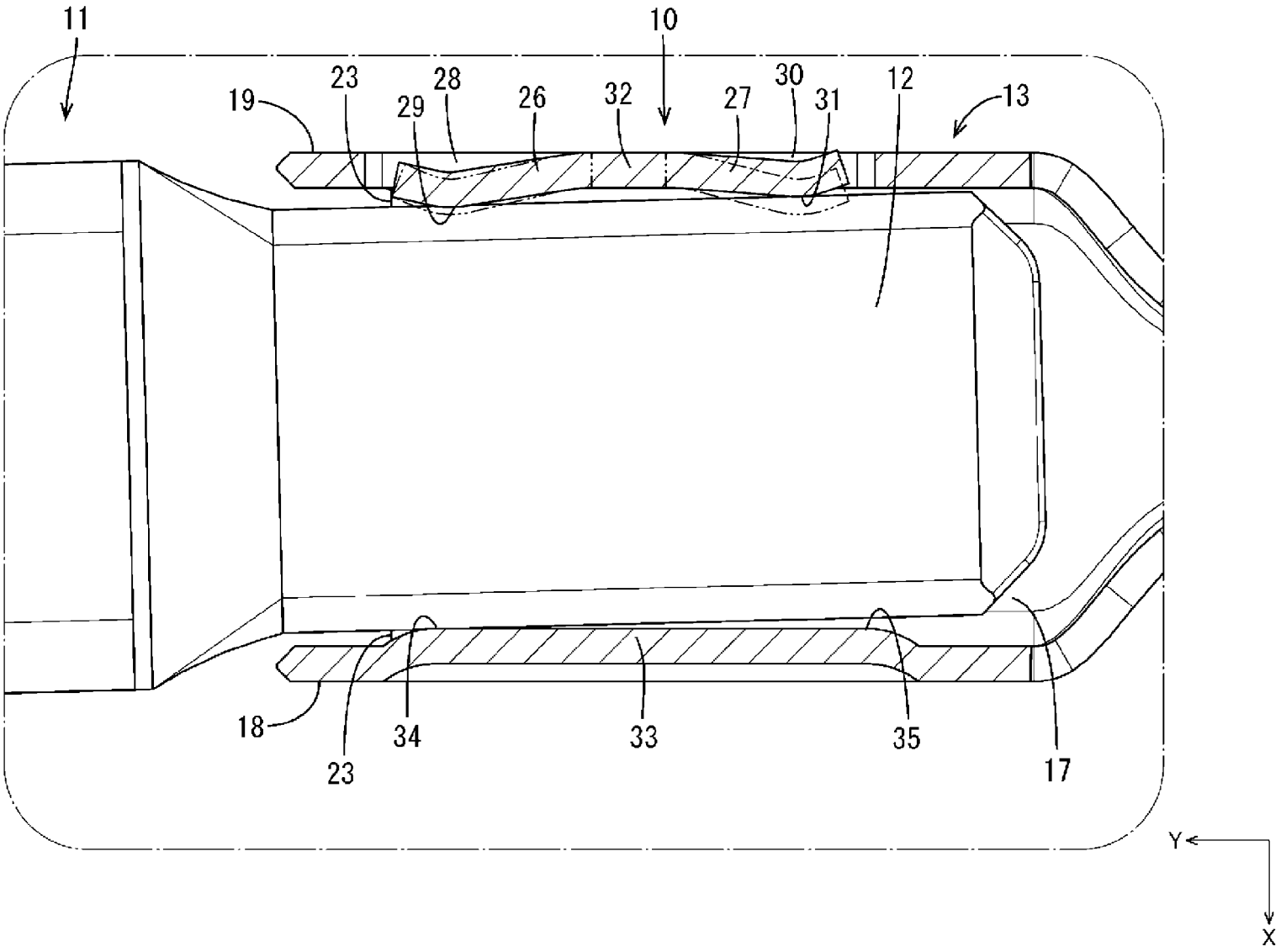
FIG. 13 is a plan view partly in section showing the deflection amounts of the front spring member and the rear spring member in the state where the male terminal relatively rotates about the front end part of the projecting portion as the center of rotation.

At this time, as shown in a chain double-dashed line in FIG. 13, a resilient deformation amount of the rear spring member 27 is larger than that of the front spring member 26.

Thus, a force applied to the male tab 12 by the rear spring member 27 is larger than a force applied to the male tab 12 by the front spring member 26. Therefore, the relative rotation of the male tab 12 about the axis extending in the height direction with the front end part 34 of the projecting portion 33 as the center of rotation is further suppressed.

Figure 14:
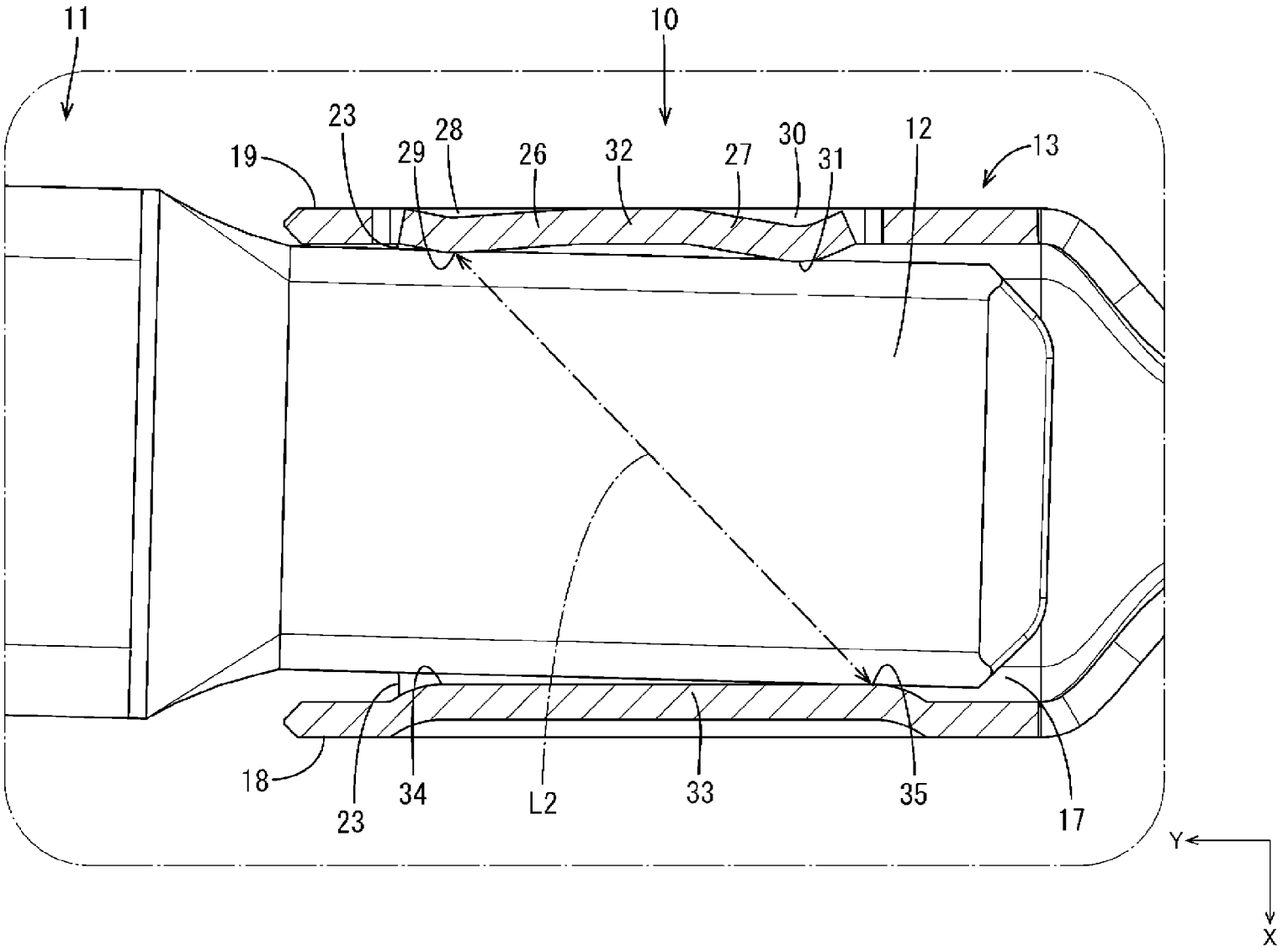
FIG. 14 is a plan view partly in section showing a state where the male terminal relatively rotates about a rear end part of a projecting portion as a center of rotation.

On the other hand, if the male tab 12 is going to relatively rotate about an axis extending in the height direction with the rear end part 35 of the projecting portion 33 as a center of rotation as shown in FIG. 14, the front pressing portion 29 of the front spring member 26 tries to suppress the rotation of the male tab 12 by pressing the right side edge of the male tab 12 leftward and functioning as a fulcrum. In this embodiment, an interval L2 between the rear end part 35 of the projecting portion 33 serving as the center of rotation of the male tab 12 and the front pressing portion 29 of the front spring member 26 functioning as the fulcrum to suppress the rotation of the male tab 12 is set to be relatively large. In this way, the interval between the center of rotation and the fulcrum can be set to be relatively larger, wherefore the relative rotation of the male tab 12 can be effectively suppressed.

Figure 15:
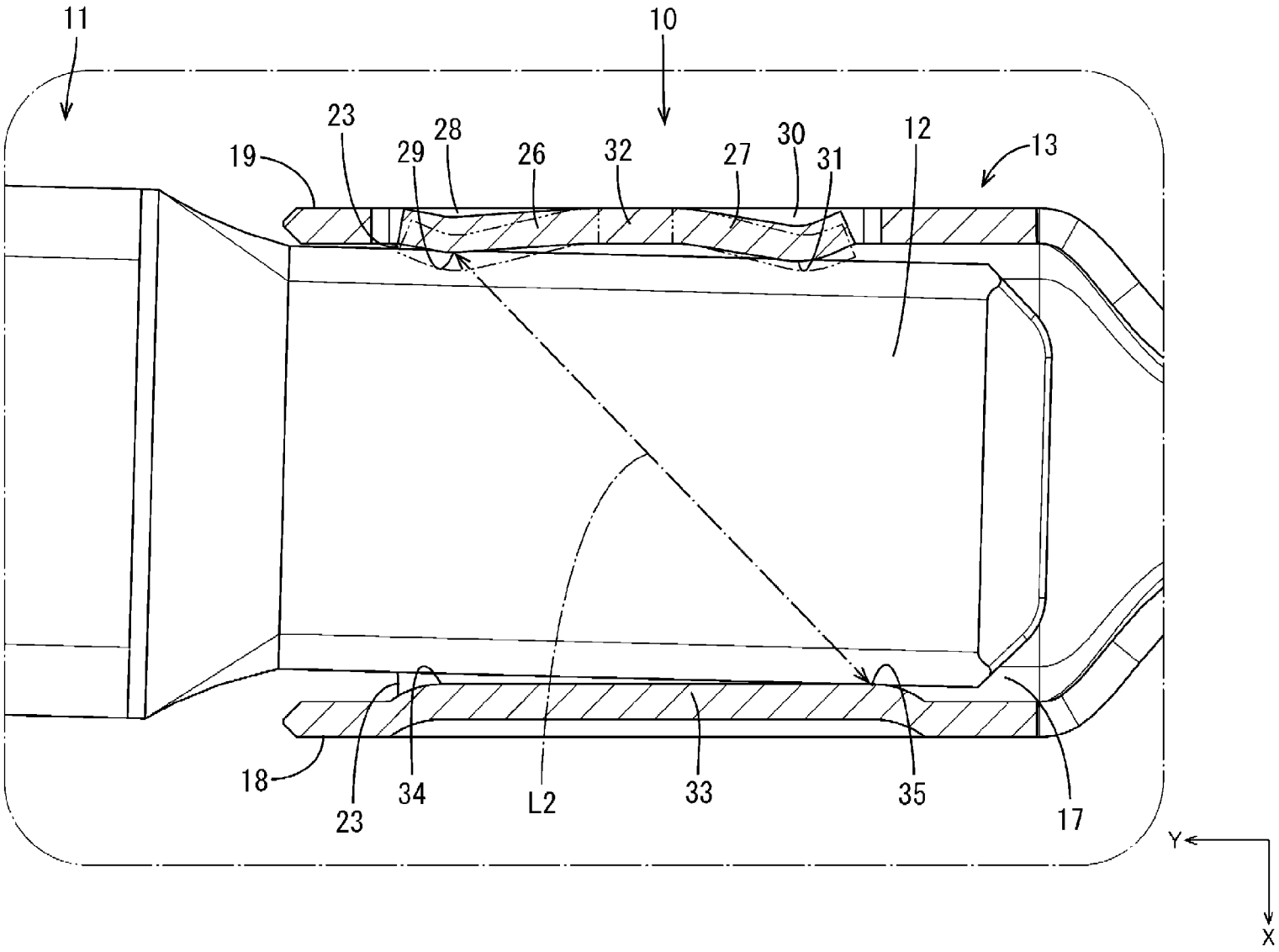
FIG. 15 is a plan view partly in section showing the deflection amounts of the front spring member and the rear spring member in the state where the male terminal relatively rotates about the rear end part of the projecting portion as the center of rotation.

At this time, as shown in a chain double-dashed line in FIG. 15, a resilient deformation amount of the front spring member 26 is larger than that of the rear spring member 27. Thus, a force applied to the male tab 12 by the front spring member 26 is larger than a force applied to the male tab 12 by the rear spring member 27. Therefore, the relative rotation of the male tab 12 about the axis extending in the height direction with the rear end part 35 of the projecting portion 33 as the center of rotation is further suppressed.

Further, according to this embodiment, the front pressing portion 29 of the front spring member 26, the contact protrusion 24 of the resilient contact piece 22 and the rear pressing portion 31 of the rear spring member 27 are disposed side by side in the length direction.

According to the above configuration, the male terminal 11 successively contacts the front pressing portion 29 of the front spring member 26, the contact protrusion 24 of the resilient contact piece 22 and the rear pressing portion 31 of the rear spring member 27 in an insertion process of the male terminal 11. Since an insertion force of the male terminal 11 is dispersed in this way, a maximum insertion force of the male terminal 11 can be reduced.

Second Embodiment

Figure 16:
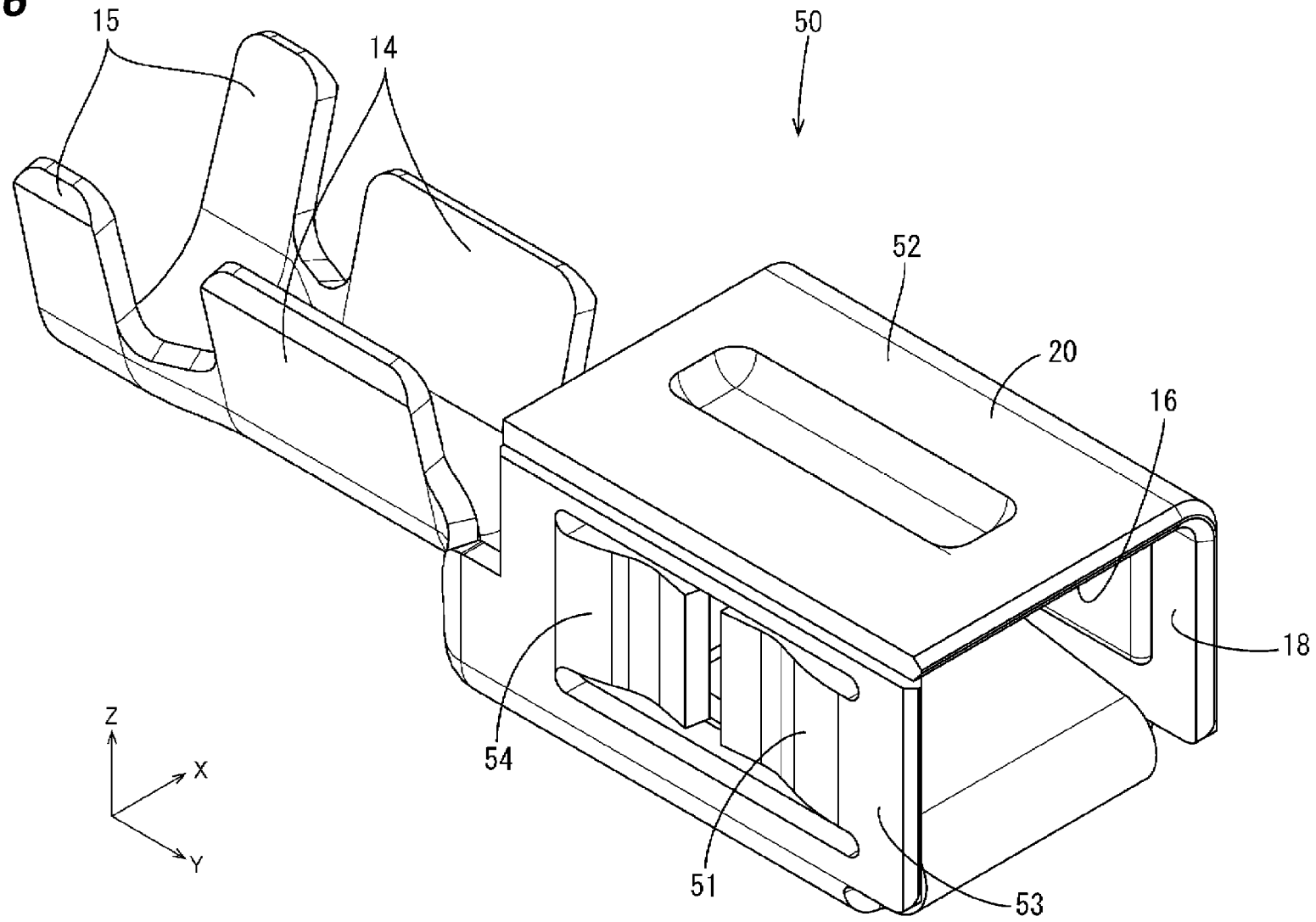
FIG. 16 is a perspective view showing a female terminal according to a second embodiment.
Figure 17:
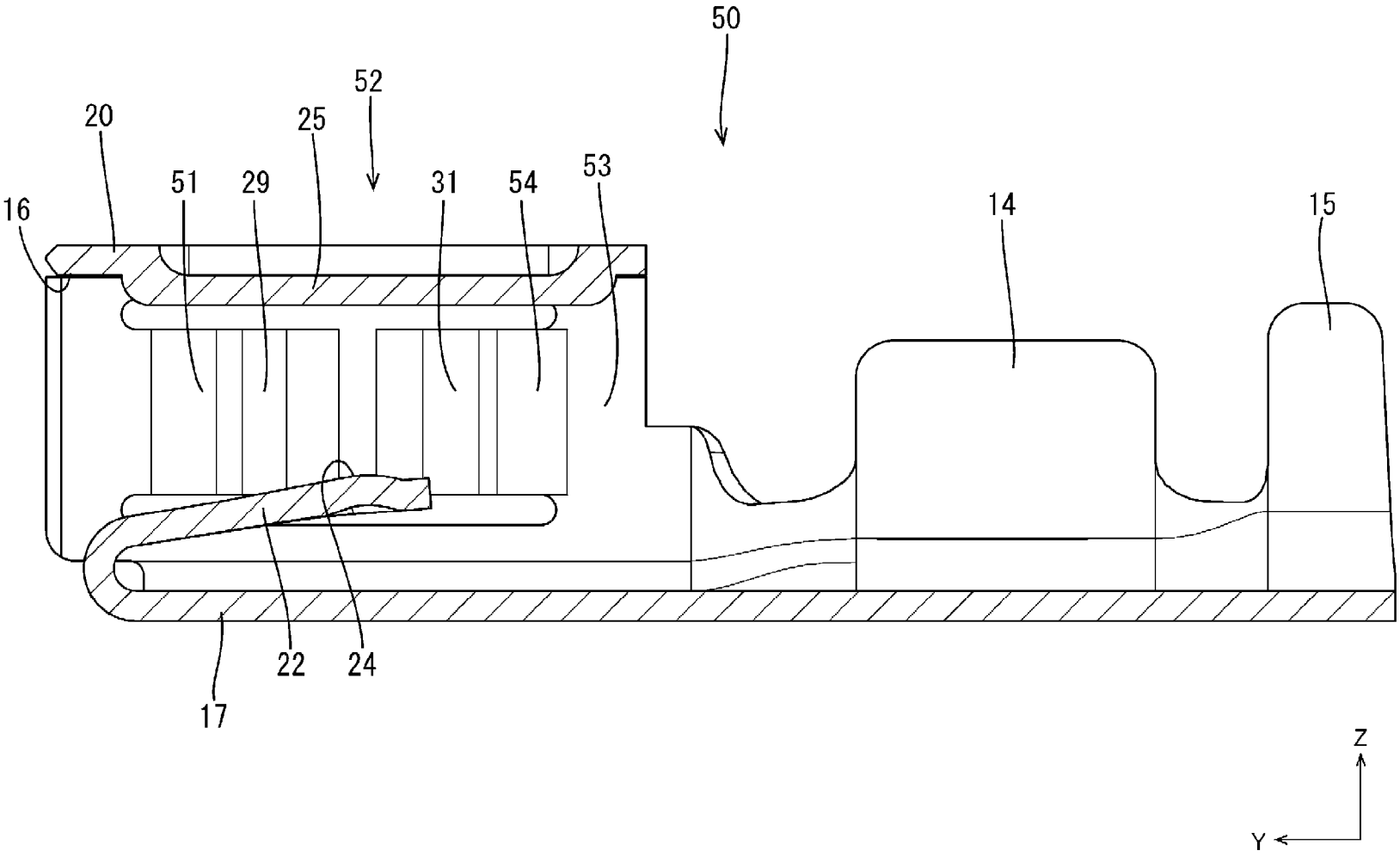
FIG. 17 is a side view in section of the female terminal.
Figure 18:
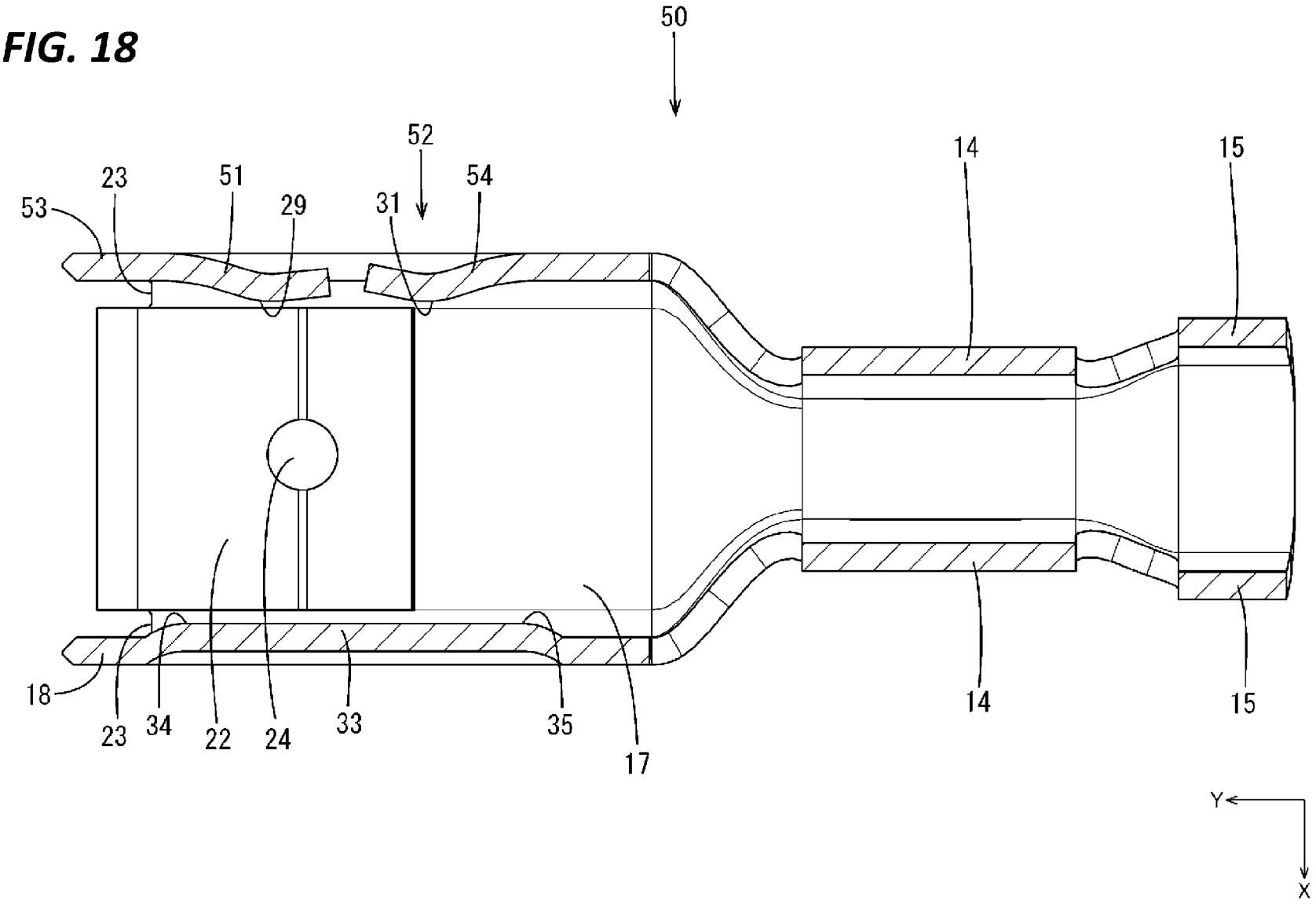
FIG. 18 is a plan view in section showing the female terminal.

Next, a second embodiment of the technique disclosed in this specification is described with reference to FIGS. 16 to 18.

In a female terminal 50 according to this embodiment, a front spring member 51 is in the form of a leaf spring extending rearward from a position near a front end part in a length direction of a right side wall 53 of a terminal connecting portion 52. The front spring member 51 is resiliently deformed outward (rightward) in a width direction with a base end as a fulcrum. A rear end part of the front spring member 51 is a free end.

Further, in this embodiment, a rear spring member 54 is in the form of a leaf spring extending forward from a position near a rear end part in the length direction of the right side wall 53 of the terminal connecting portion 52. The rear spring member 54 is resiliently deformed outward (rightward) in the width direction with a base end as a fulcrum. A front end part of the rear spring member 54 is a free end.

A rear end part of the front spring member 51 and a front end part of the rear spring member 54 are disposed across a gap in the length direction.

Since the configuration other than the above is substantially the same as in the first embodiment, the same components are denoted by the same reference signs and repeated description is omitted.

Third Embodiment

Figure 19:
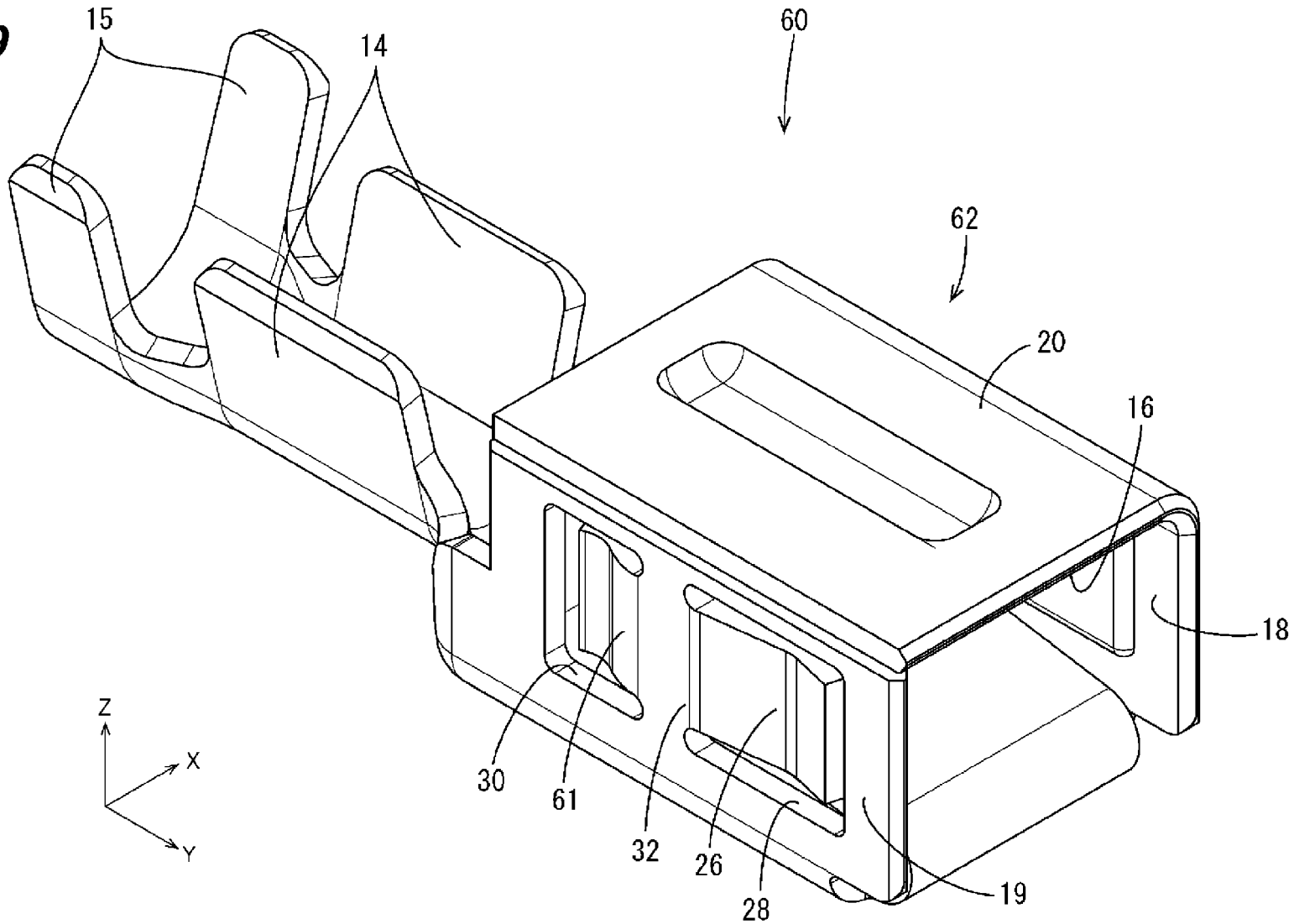
FIG. 19 is a perspective view showing a female terminal according to a third embodiment.
Figure 20:
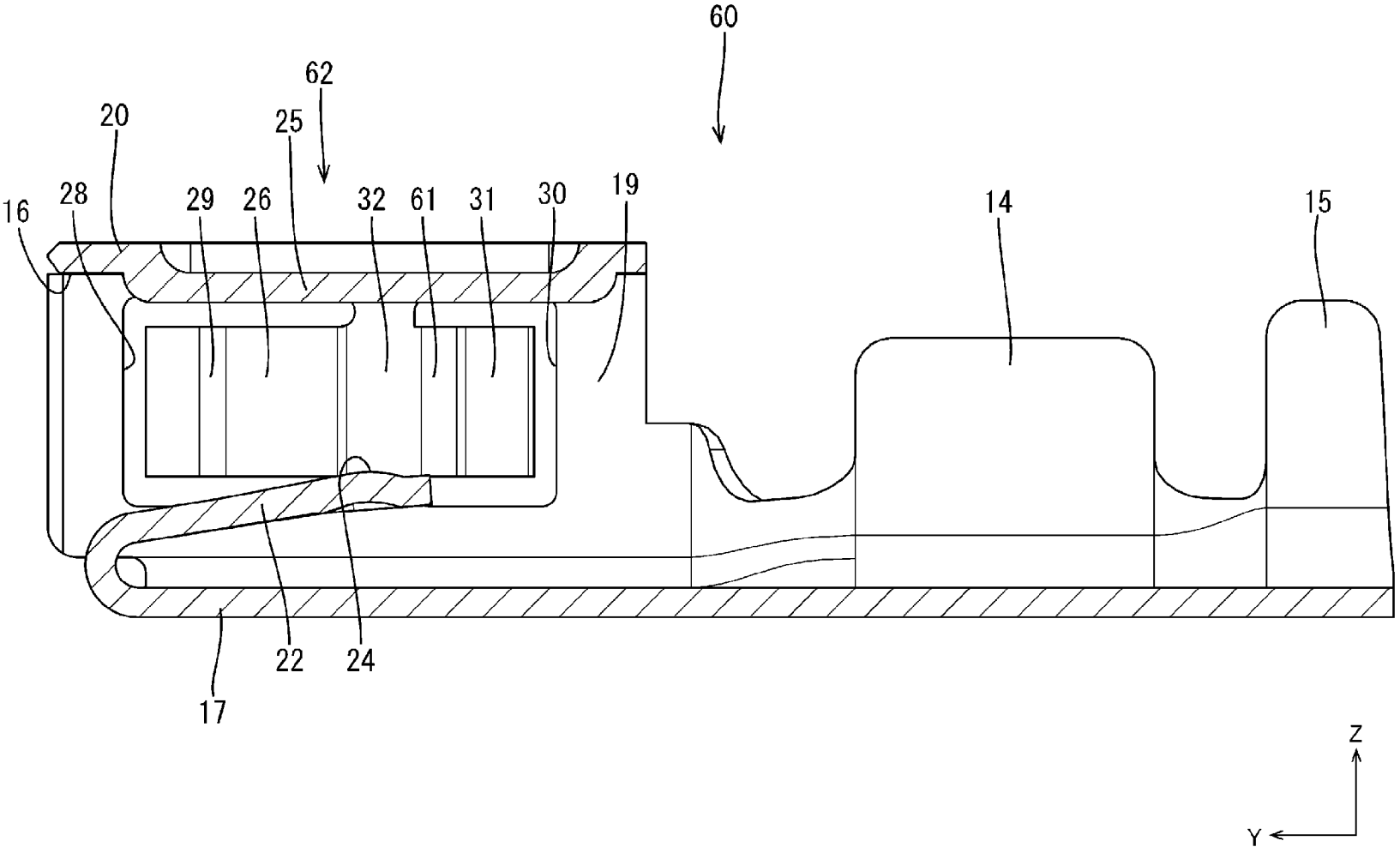
FIG. 20 is a side view in section of the female terminal.
Figure 21:
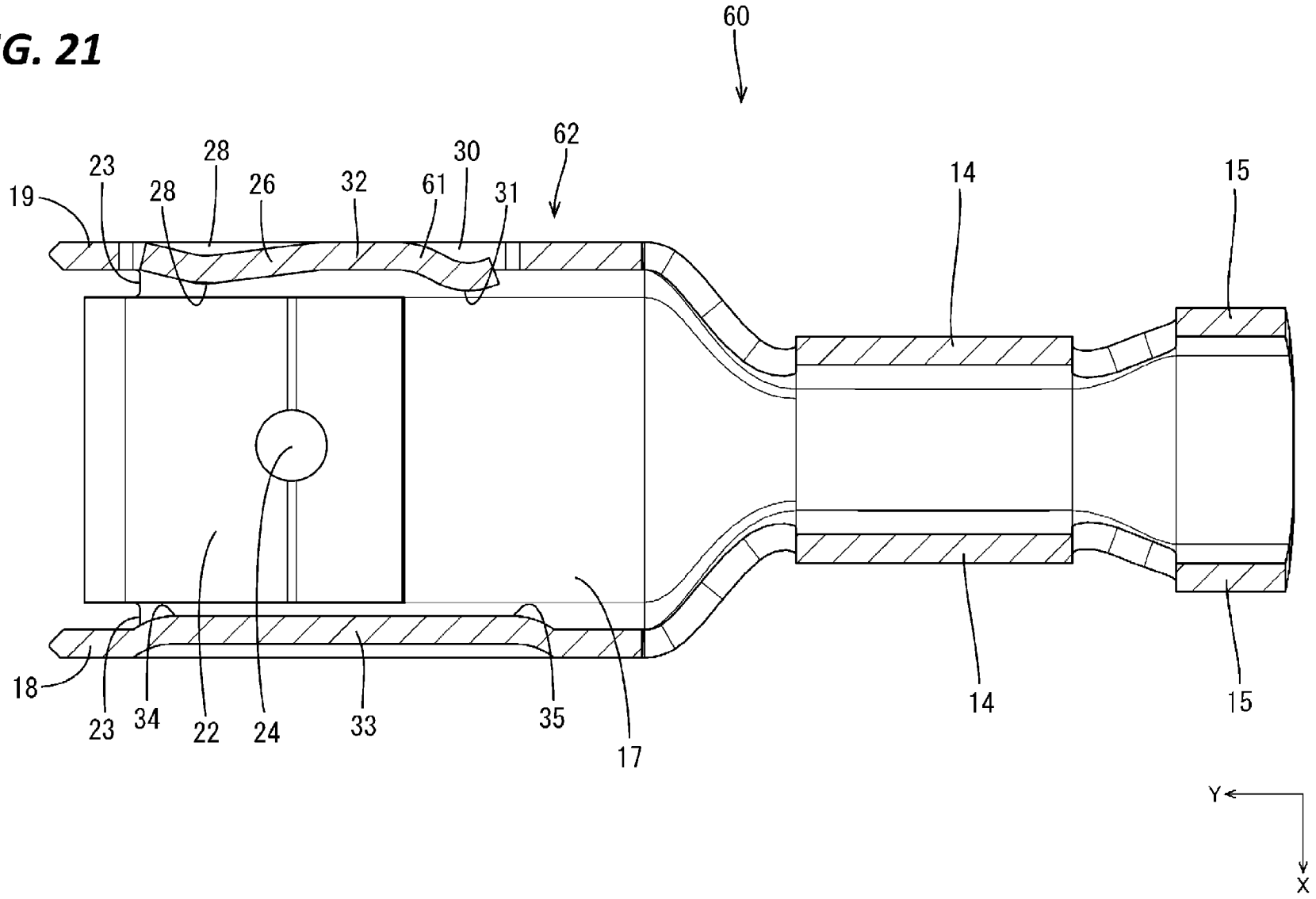
FIG. 21 is a plan view in section showing the female terminal.

Next, a third embodiment of the technique disclosed in this specification is described with reference to FIGS. 19 to 21.

In a female terminal 60 according to this embodiment, a length of a rear spring member 61 provided in a terminal connecting portion 62 is set to be shorter than that of the rear spring member 27 according to the first embodiment. Since the configuration other than the above is substantially the same as in the first embodiment, the same components are denoted by the same reference signs and repeated description is omitted.

If a male tab 12 relatively rotates about an axis extending in a height direction with a front end part in the length direction of a projecting portion 33 as a center of rotation, a rear pressing portion 31 of the rear spring member 61 comes into contact with the right side edge of the male tab 12 from a right side in a width direction. Then, the rear spring member 61 is pressed rightward in the width direction. In this way, a front spring member 26 and the rear spring member 61 act like a seesaw as a whole and the front spring member 26 presses the right side edge of the male tab 12 from the right side. In this embodiment, the length of the rear spring member 61 is set to be relatively short. Thus, a force applied to the rear spring member 61 from the male tab 12 is efficiently converted into a force for pressing the front spring member 26 against the male tab 12. As a result, the front and rear spring members 26, 61 cooperate to press the male tab 11 against the projecting portion 33, wherefore the relative rotation of the male tab 11 about the axis extending in the height direction can be effectively suppressed.

Fourth Embodiment

Next, a fourth embodiment of the technique disclosed in this specification is described with reference to FIGS. 22 to 25.

Figure 22:
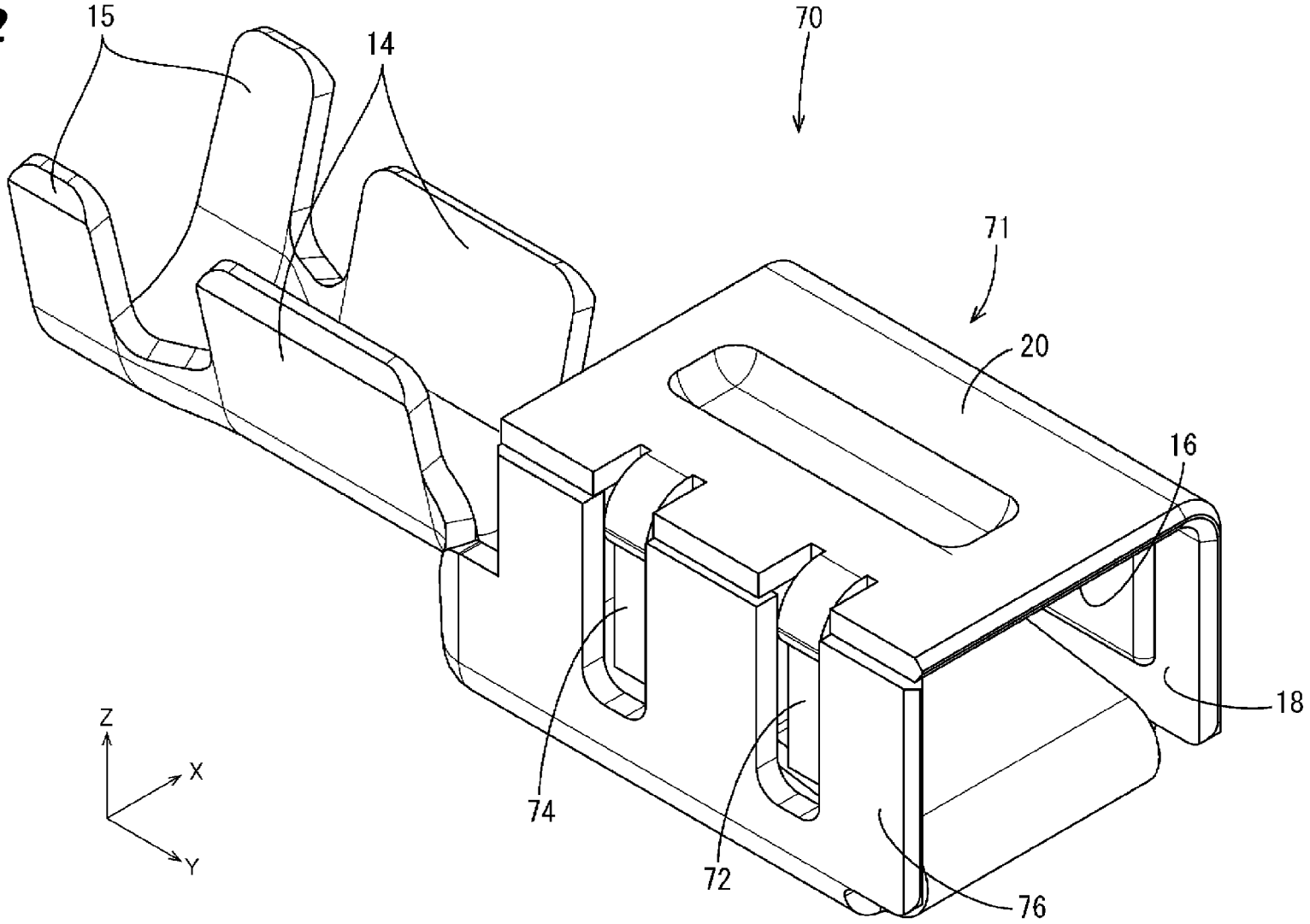
FIG. 22 is a perspective view showing a female terminal according to a fourth embodiment.
Figure 23:
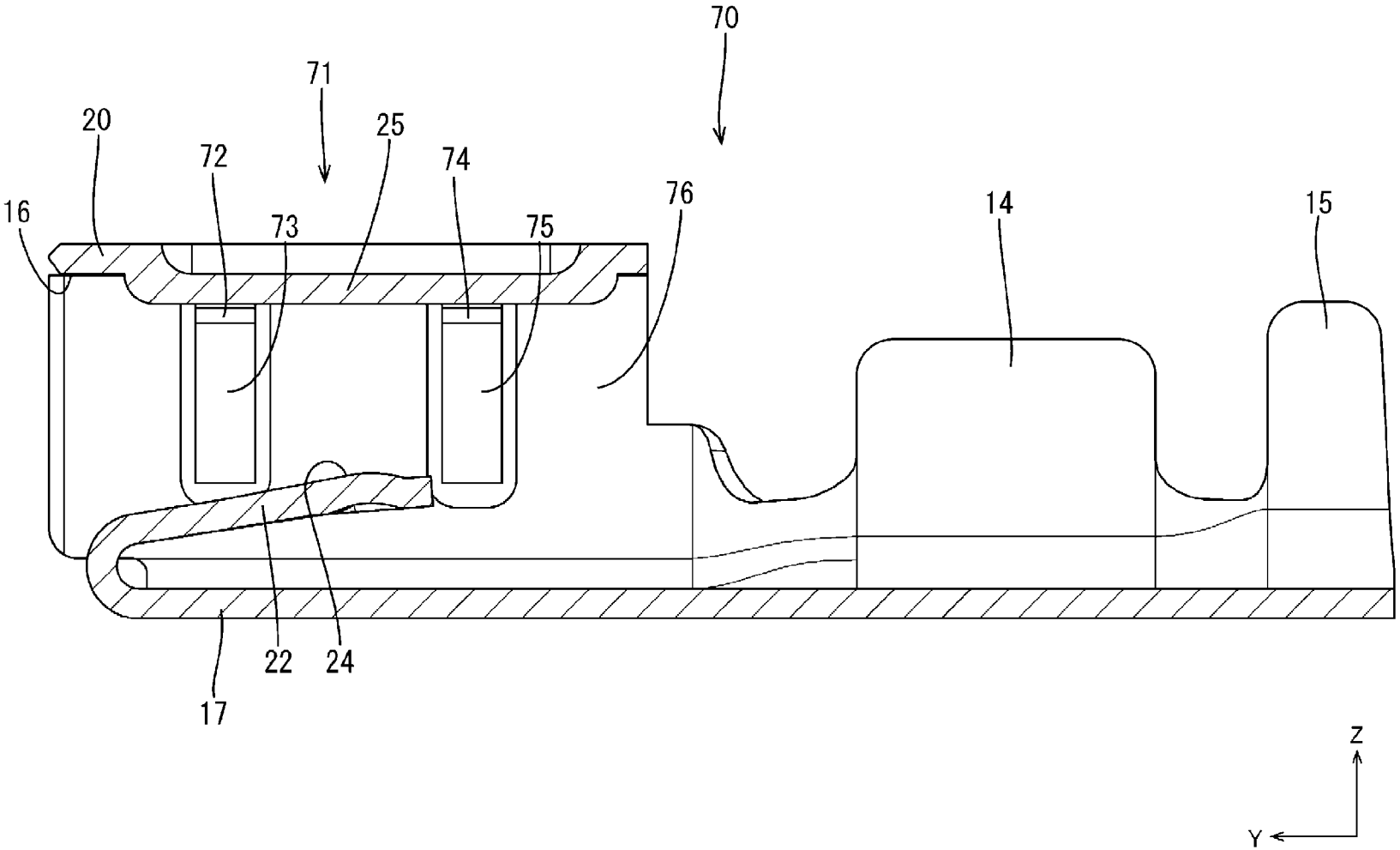
FIG. 23 is a side view in section of the female terminal.
Figure 24:
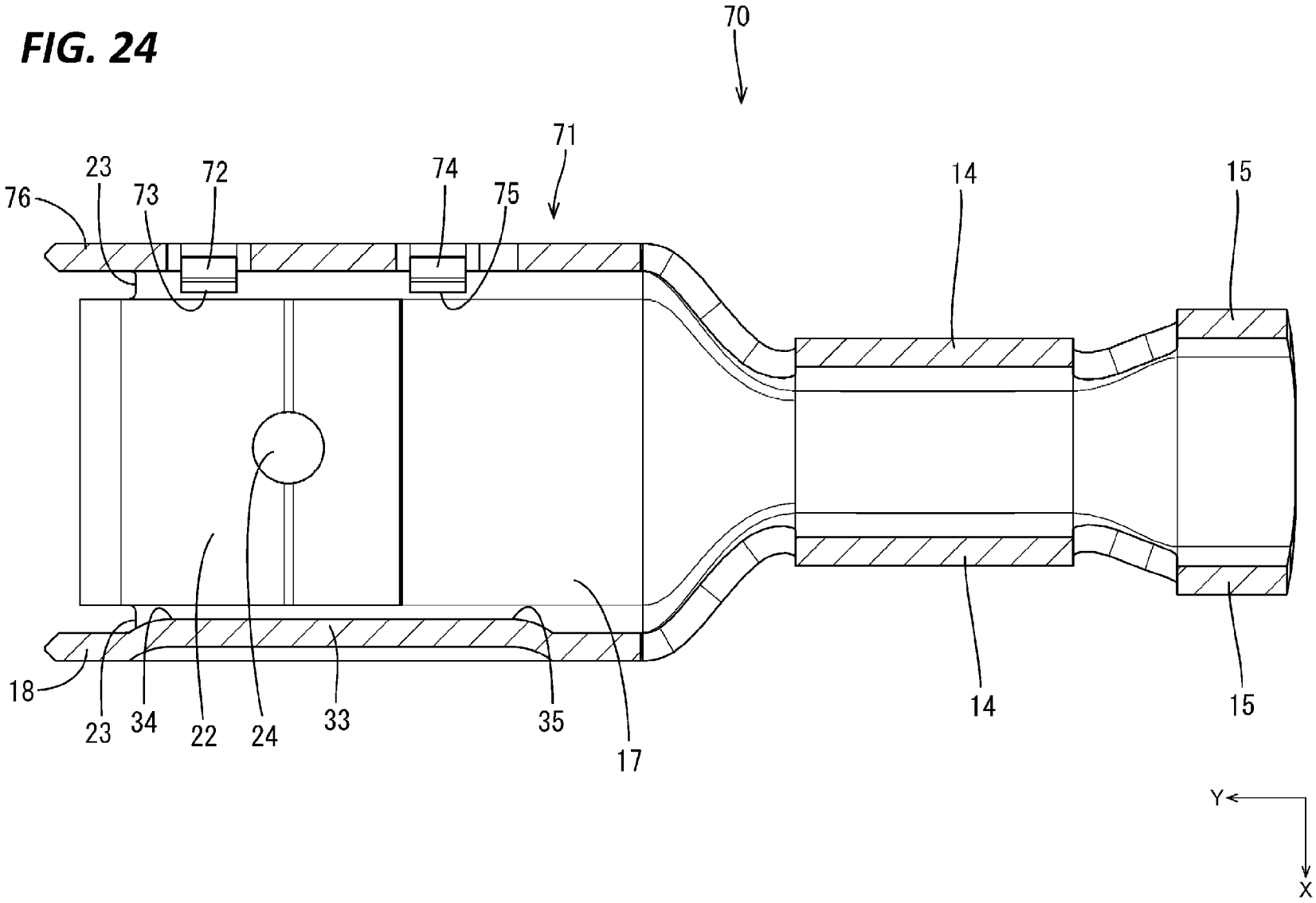
FIG. 24 is a plan view in section showing the female terminal.
Figure 25:
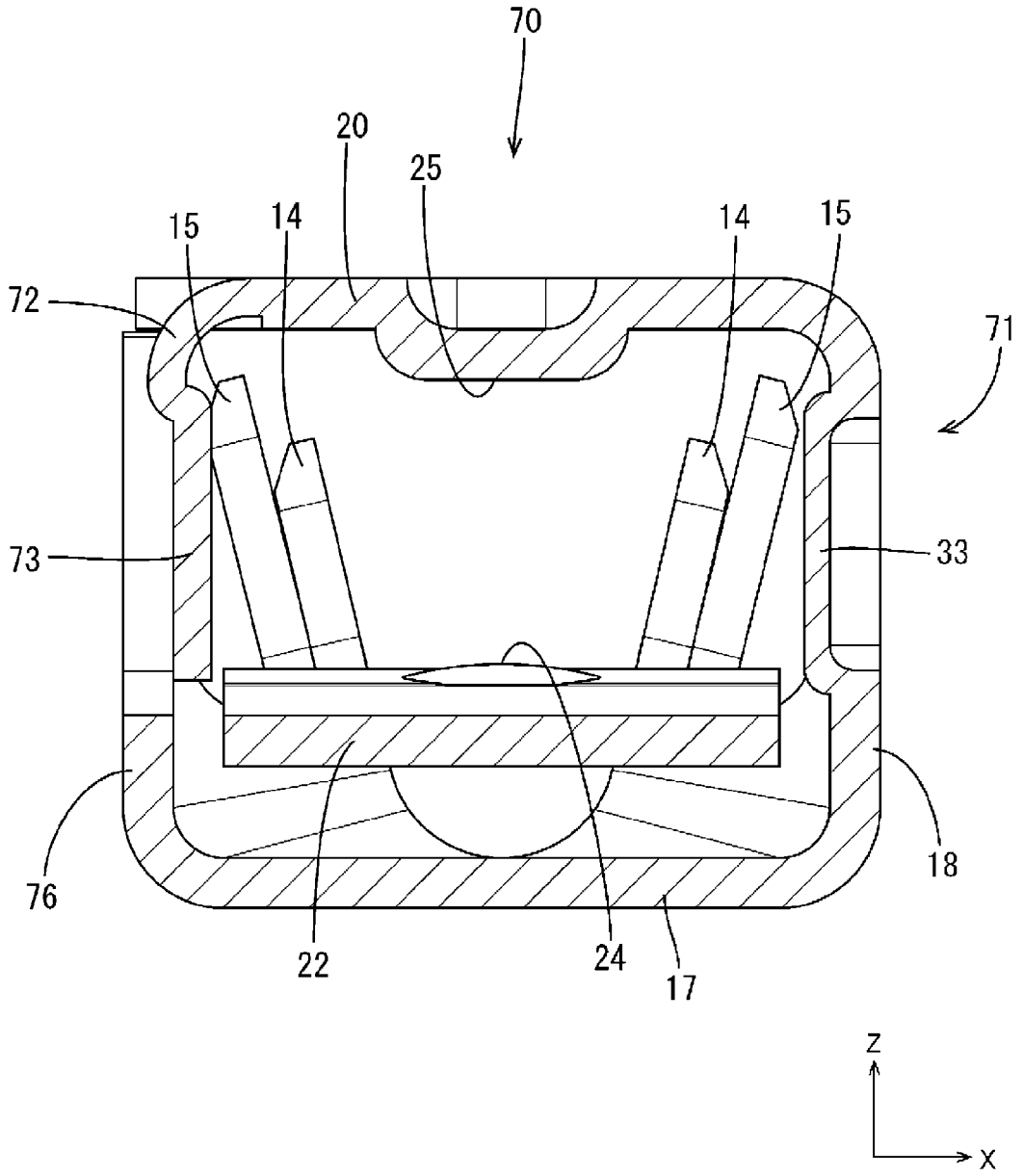
FIG. 25 is a section showing the female terminal cut along a plane orthogonal to a length direction.

As shown in FIG. 22, in a female terminal 70 according to this embodiment, a front spring member 72 is formed to extend downward from a position on a front side of a terminal connecting portion 71 and near an upper end part of a right side wall 76 of the terminal connecting portion 71. As shown in FIG. 23, a height position of a lower end part of the front spring member 72 is located below an upper end part of a contact protrusion 24 of a resilient contact piece 22. As shown in FIG. 25, a part of the front spring member 72 near the lower end part projects leftward (inward) in a width direction and serves as a front pressing portion 73 configured to come into contact with the right side edge of a male tab 12 from a right side.

Further, as shown in FIG. 22, a rear spring member 74 is formed to extend downward from a position on a rear side of the terminal connecting portion 71 and near the upper end part of the right side wall 76 of the terminal connecting portion 71. As shown in FIG. 23, a height position of a lower end part of the rear spring member 74 is located below the upper end part of the contact protrusion 24 of the resilient contact piece 22. A part of the rear spring member 74 near the lower end part projects leftward (inward) in the width direction and serves as a rear pressing portion 75 configured to come into contact with the right side edge of the male tab 12 from the right side.

As shown in FIG. 25, a front pressing portion 73 of the front spring member 72 and a rear projecting portion 75 of the rear spring member 74 are provided to face a projecting portion 33 in a state where the male tab 12 is not inserted in the terminal connecting portion 71.

Since the configuration other than the above is substantially the same as in the first embodiment, the same components are denoted by the same reference signs and repeated description is omitted.

According to this embodiment, even if the terminal connecting portion 71 does not have a sufficient length in the length direction, the front and rear spring members 72, 74 can be formed to extend in the height direction of the terminal connecting portion 71. In this way, a degree of freedom in designing the female terminal 70 can be improved.

Although both the front and rear spring members 72, 74 are configured to extend downward from the positions near the upper end part of the terminal connecting portion 71 in this embodiment, there is no limitation to this. For example, both the front and rear spring members 72, 74 may be configured to extend upward from positions near a lower end part of the terminal connecting portion 71 or one of both the front and rear spring members 72, 74 may be configured to extend downward from a position near the upper end part of the terminal connecting portion 71 and the other may be configured to extend upward from a position near the lower end of the terminal connecting portion 71.

Fifth Embodiment

Next, a fifth embodiment of the technique disclosed in this specification is described with reference to FIGS. 26 to 34.

(Terminal Connecting Portion 81)

Figure 26:
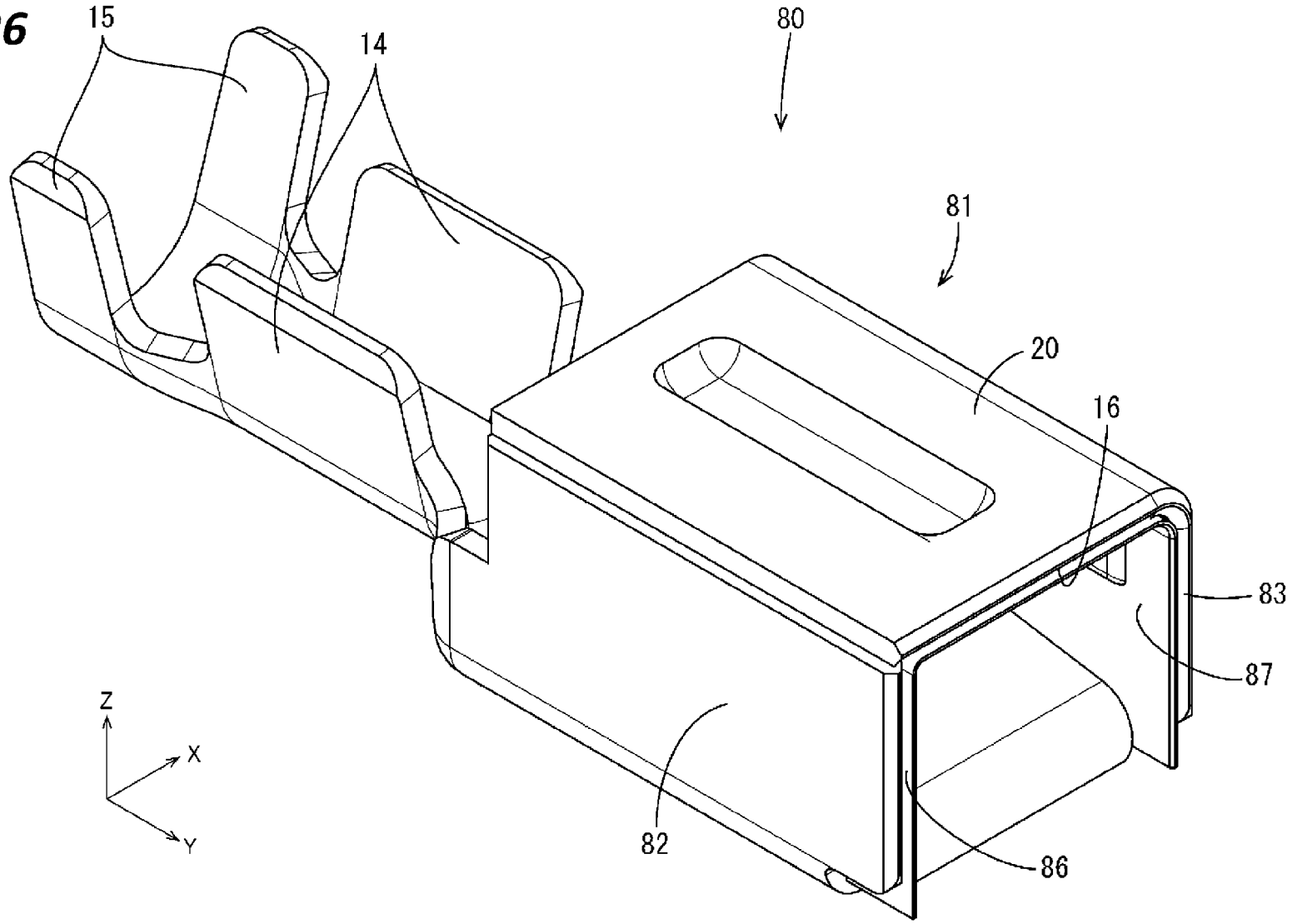
FIG. 26 is a perspective view showing a female terminal according to a fifth embodiment.
Figure 27:
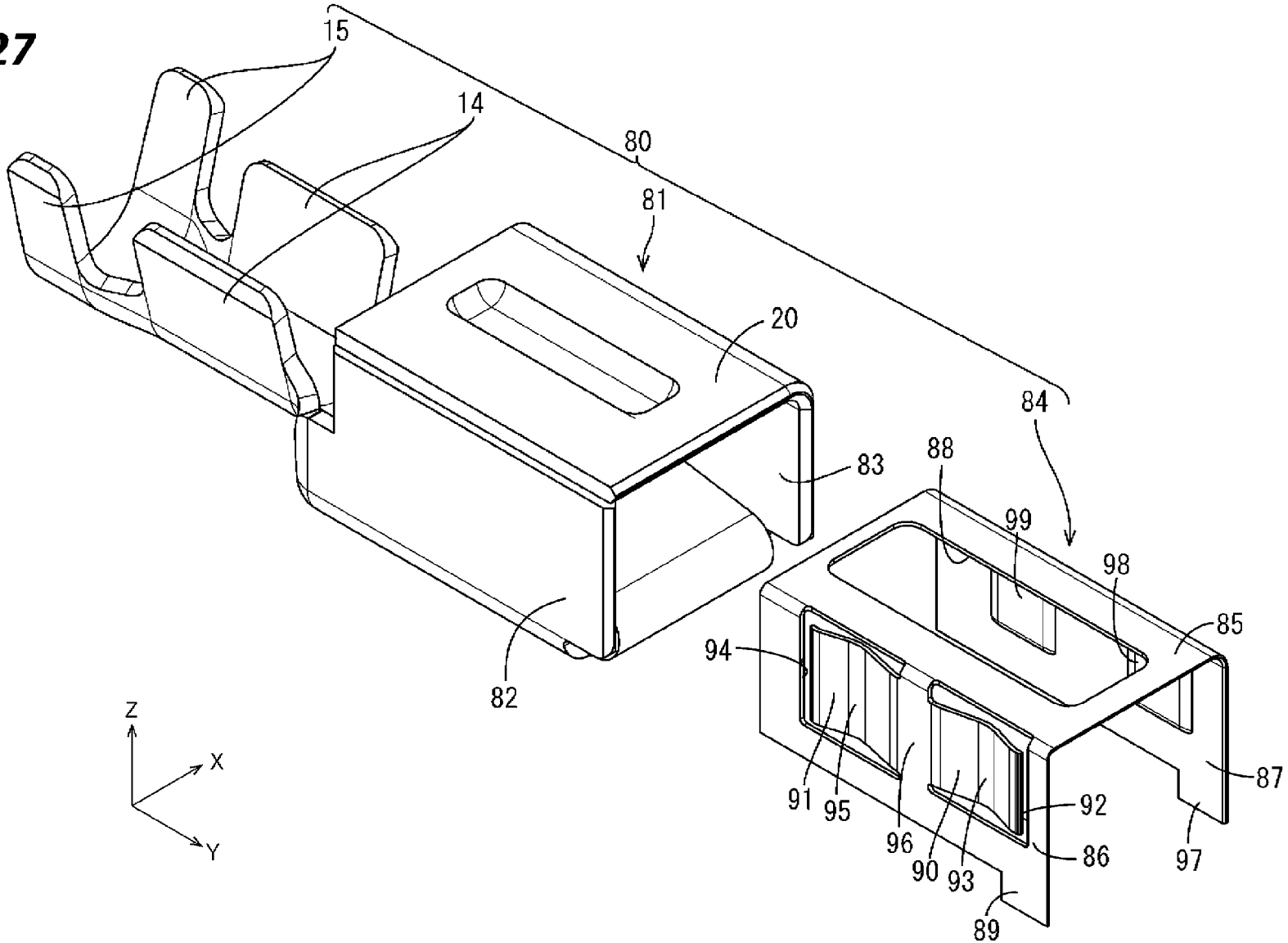
FIG. 27 is an exploded perspective view showing the female terminal and a spring structure.

As shown in FIGS. 26 and 27, in a female terminal 80 according to this embodiment, a right side wall 82 of a terminal connecting portion 81 is not formed with front and rear spring members. Further, a left side wall 83 of the terminal connecting portion 81 is not formed with a projecting portion. Thus, the terminal connecting portion 81 is in the form of a rectangular tube extending in a length direction, and a resilient contact piece 22 is folded rearward from the front end edge of a bottom wall 17.

(Spring Structure 84)

Figure 30:
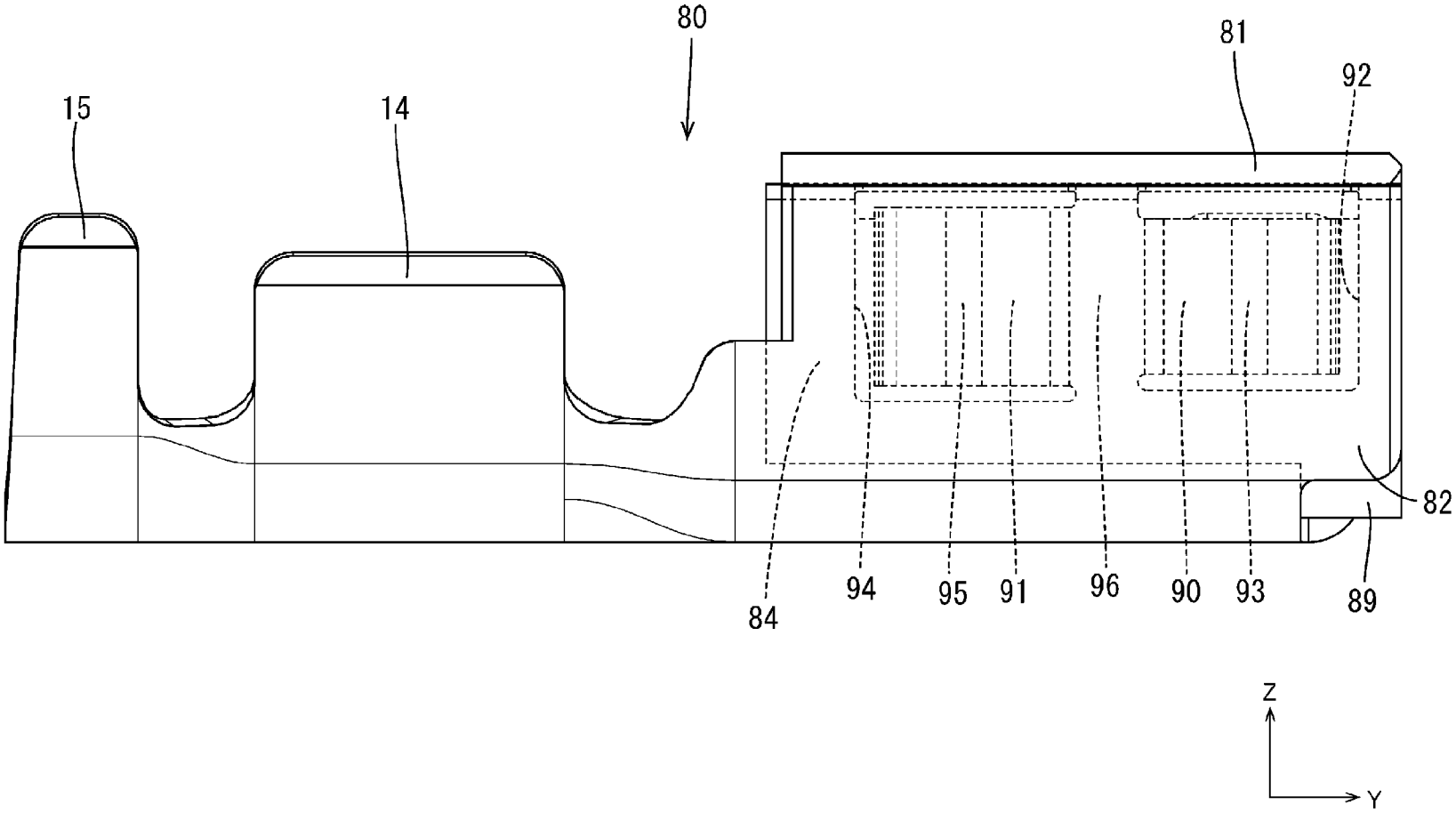
FIG. 30 is a side view showing the female terminal in a state where the spring structure is assembled.
Figure 31:
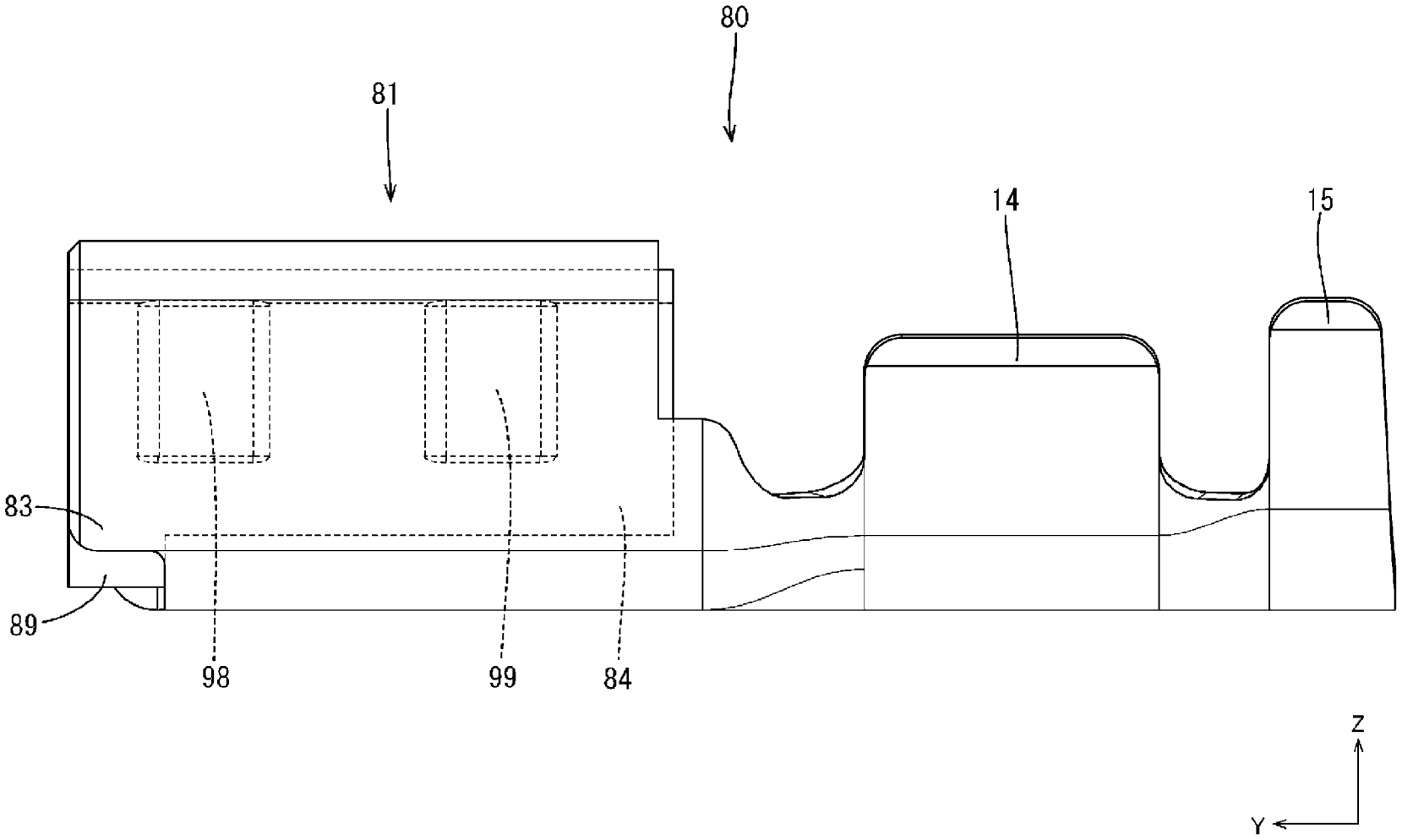
FIG. 31 is a side view showing the female terminal in the state where the spring structure is assembled.

As shown in FIGS. 30 and 31, a spring structure 84 separate from the terminal connecting portion 81 is accommodated inside the terminal connecting portion 81. The spring structure 84 is formed by press-working a metal plate material into a predetermined shape. An arbitrary metal such as copper, copper alloy, aluminum, aluminum alloy or stainless steel can be appropriately selected according to need as a metal constituting the spring structure 84. In this embodiment, stainless steel excellent in strength is used. A thickness of the metal plate material constituting the spring structure 84 is smaller than a thickness of a metal plate material constituting the female terminal 80.

Figure 28:
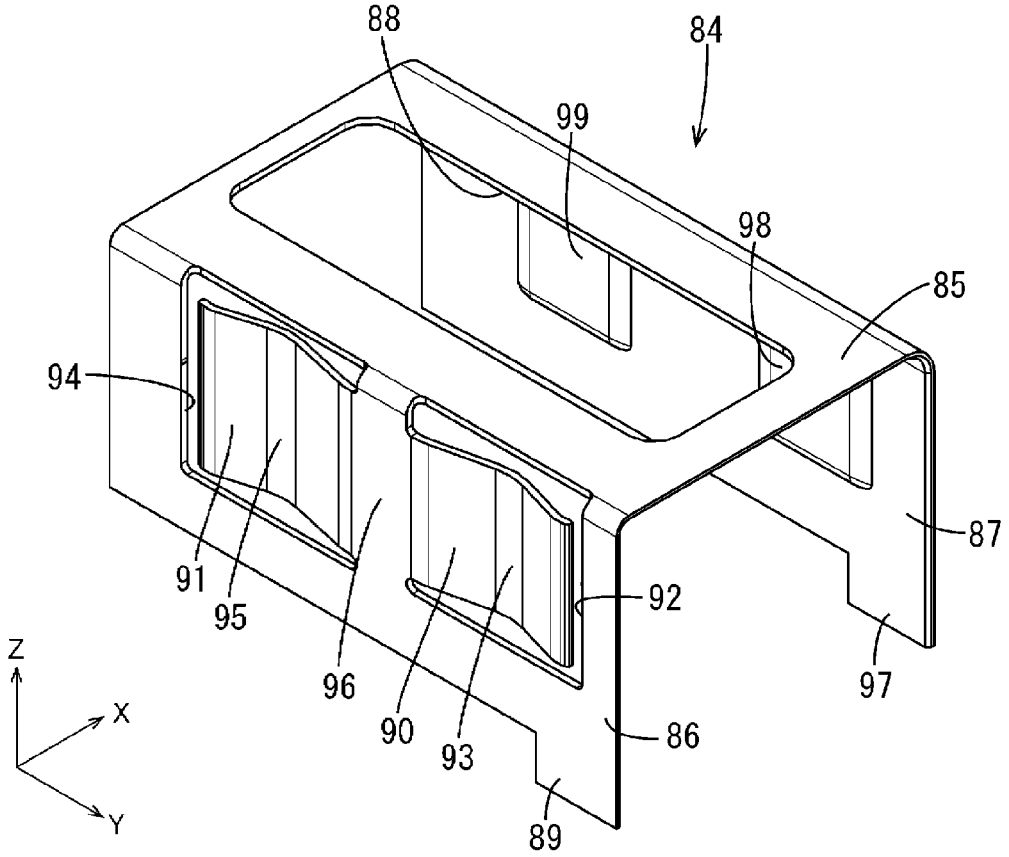
FIG. 28 is a perspective view showing the spring structure.

As shown in FIG. 28, the spring structure 84 includes an upper wall 85, a right side wall 86 extending downward from the right side edge of the upper wall 85 and a left side wall 87 extending downward from the left side edge of the upper wall 85.

(Upper Wall 85)

The upper wall 85 of the spring structure 84 has a rectangular shape extending in the length direction. The upper wall 85 is formed with a window portion 88 extending in a front-rear direction and penetrating through the upper wall 85. The window portion 88 has a rectangular shape with rounded corners extending in the length direction. A length of the window portion 88 is set to be equal to or larger than that of a rib 25 formed in the terminal connecting portion 81 of the female terminal 80. A width of the window portion 88 is set to be equal to or larger than that of the rib 25. With the spring structure 84 accommodated inside the terminal connecting portion 81, the window portion 88 is set at a position corresponding to the rib 25 of the terminal connecting portion 81. In this way, with the spring structure 84 accommodated inside the terminal connecting portion 81, the rib 25 formed on the upper wall 85 of the terminal connecting portion 81 penetrates through the window portion 88 from above. A lower end part of the rib 25 projects further downward than the lower surface of the upper wall 85 of the spring structure 84.

(Right Side Wall 86)

Figure 29:
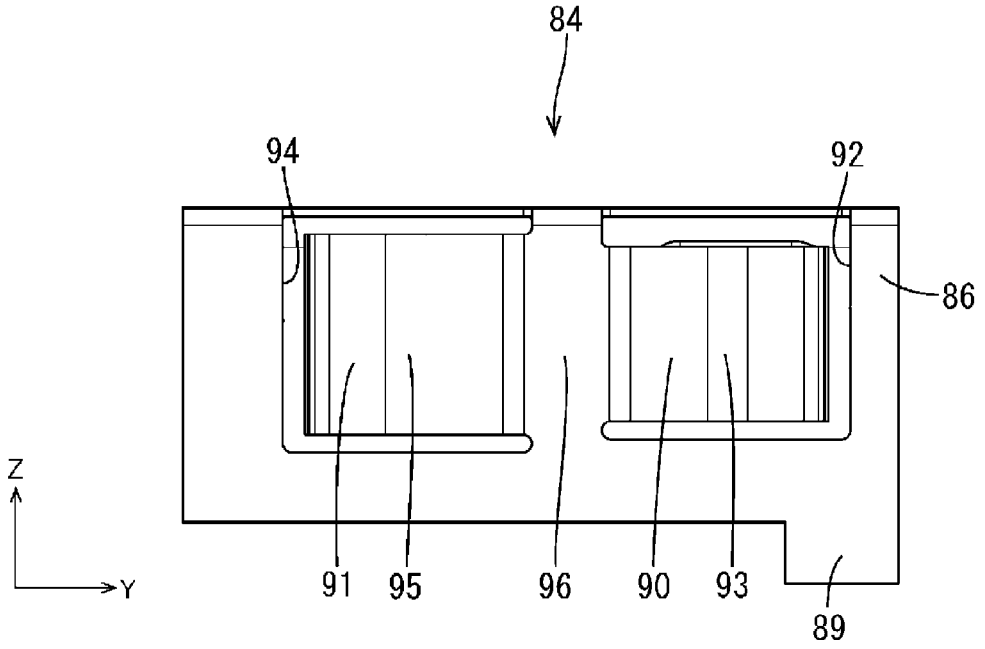
FIG. 29 is a side view of the spring structure.

As shown in FIG. 29, a right locking portion 89 projecting downward is formed on a front end part of the right side wall 86 of the spring structure 84. The right locking portion 89 is locked to a cutout 23 provided in the bottom wall 17 of the terminal connecting portion 81 from front in the length direction, whereby the spring structure 84 is positioned in the length direction with respect to the terminal connecting portion 81.

A front spring member 90 located on a front side and a rear spring member 91 located on a rear side in the length direction are provided side by side across a gap in the length direction in the right side wall 86 of the spring structure 84.

The right side wall 86 of the spring structure 84 is formed with a substantially U-shaped front slit 92 at a position on the front side in the length direction. The front spring member 90 is formed by cutting a region surrounded by the front slit 92 and raising the cut region inwardly of the spring structure 84. The front spring member 90 is in the form of a leaf spring extending forward from the vicinity of a lengthwise center position of the right side wall 86 of the spring structure 84. The front spring member 90 is resiliently deformed outward (rightward) in a width direction with a base end as a fulcrum. A front end part of the front spring member 90 is a free end. A part of the front spring member 90 near a lengthwise center is bent inward (leftward) in the width direction. This bent part serves as a front pressing portion 93.

The right side wall 86 of the spring structure 84 is formed with a substantially U-shaped rear slit 94 at a position on the rear side in the length direction. The rear spring member 91 is formed by cutting a region surrounded by the rear slit 94 and raising the cut region inwardly of the spring structure 84. The rear spring member 91 is in the form of a leaf spring extending rearward from the vicinity of the lengthwise center position of the right side wall 86 of the spring structure 84. The rear spring member 91 is resiliently deformed outward (rightward) in the width direction with a base end as a fulcrum. A rear end part of the rear spring member 91 is a free end. A part of the rear spring member 91 near a lengthwise center is bent inward (leftward) in the width direction. This bent part serves as a rear pressing portion 95.

As shown in FIG. 29, a height of the front spring member 90 is set to be smaller than that of the rear spring member 91 in a height direction. In this way, a spring constant of the front spring member 90 is set to be smaller than that of the rear spring member 91. On the other hand, a length of the front spring member 90 and that of the rear spring member 91 are set to be substantially equal in the length direction.

With the spring structure 84 accommodated inside the terminal connecting portion 81, the upper edge of the front spring member 90 is located somewhat above the lower end of the rib 25 and the upper edge of the rear spring member 91 is located somewhat above the lower end of the rib 25. Further, the lower edge of the front spring member 90 and that of the rear spring member 91 are located somewhat above the upper end of a contact protrusion 24 of the resilient contact piece 22 in a state not resiliently deformed. In a state where a male tab 12 of a male terminal 11 is inserted in the terminal connecting portion 81 and the resilient contact piece 22 is resiliently deformed downward by the male tab 12, the front and rear spring members 90, 91 are located to the right of the male tab 12. By the above configuration, the front and rear spring members 90, 91 resiliently contact the male tab 12 of the male terminal 11 from a right side in the width direction (equivalent to one side in the width direction).

Out of the right side wall 86 of the spring structure 84, a part located between the front and rear slits 92, 94 serves as a support wall 96. The strength in the height direction of the right side wall 86 of the spring structure 84 is held by this support wall 96.

Figure 32:
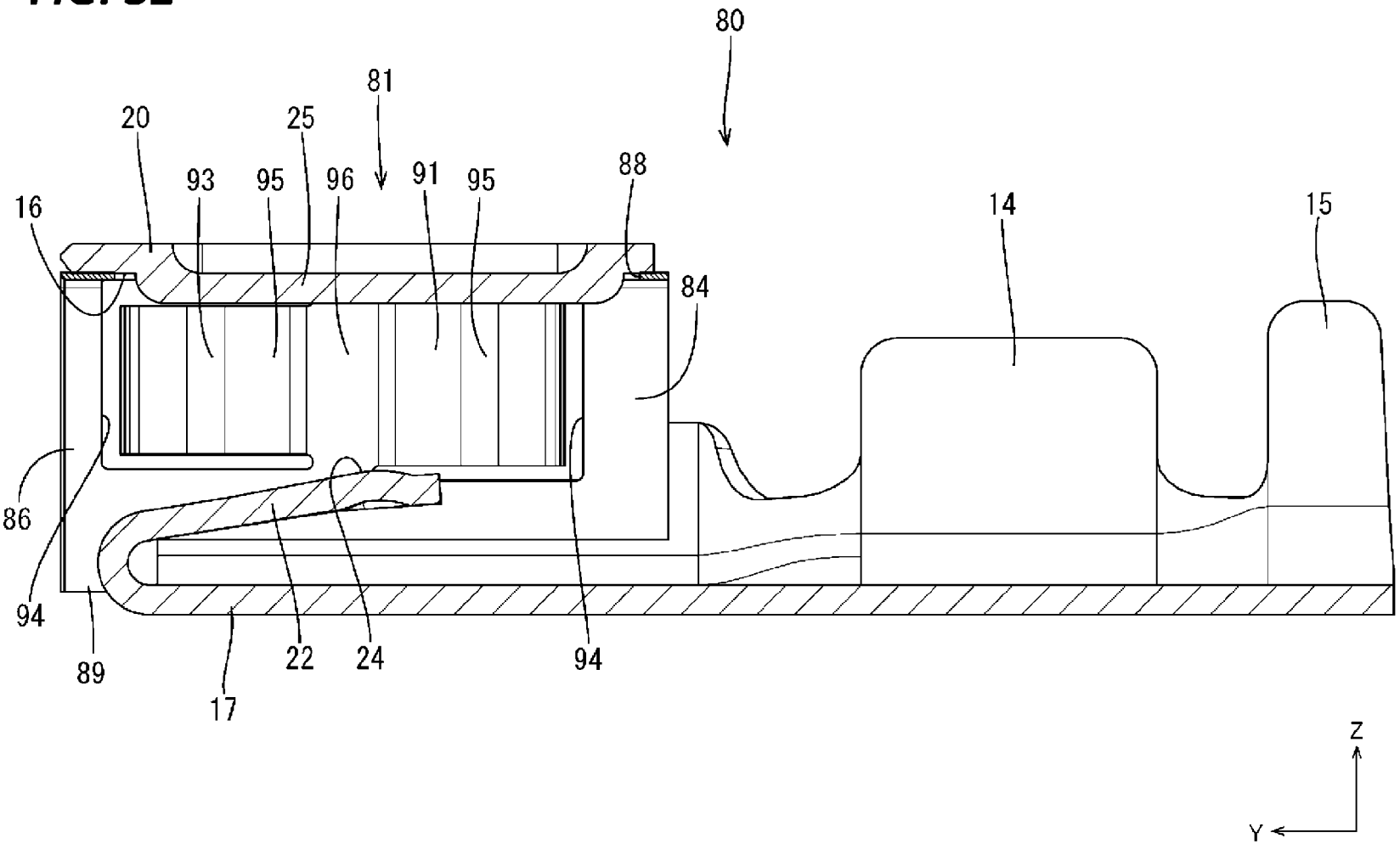
FIG. 32 is a side view in section showing the female terminal in the state where the spring structure is assembled.
Figure 33:
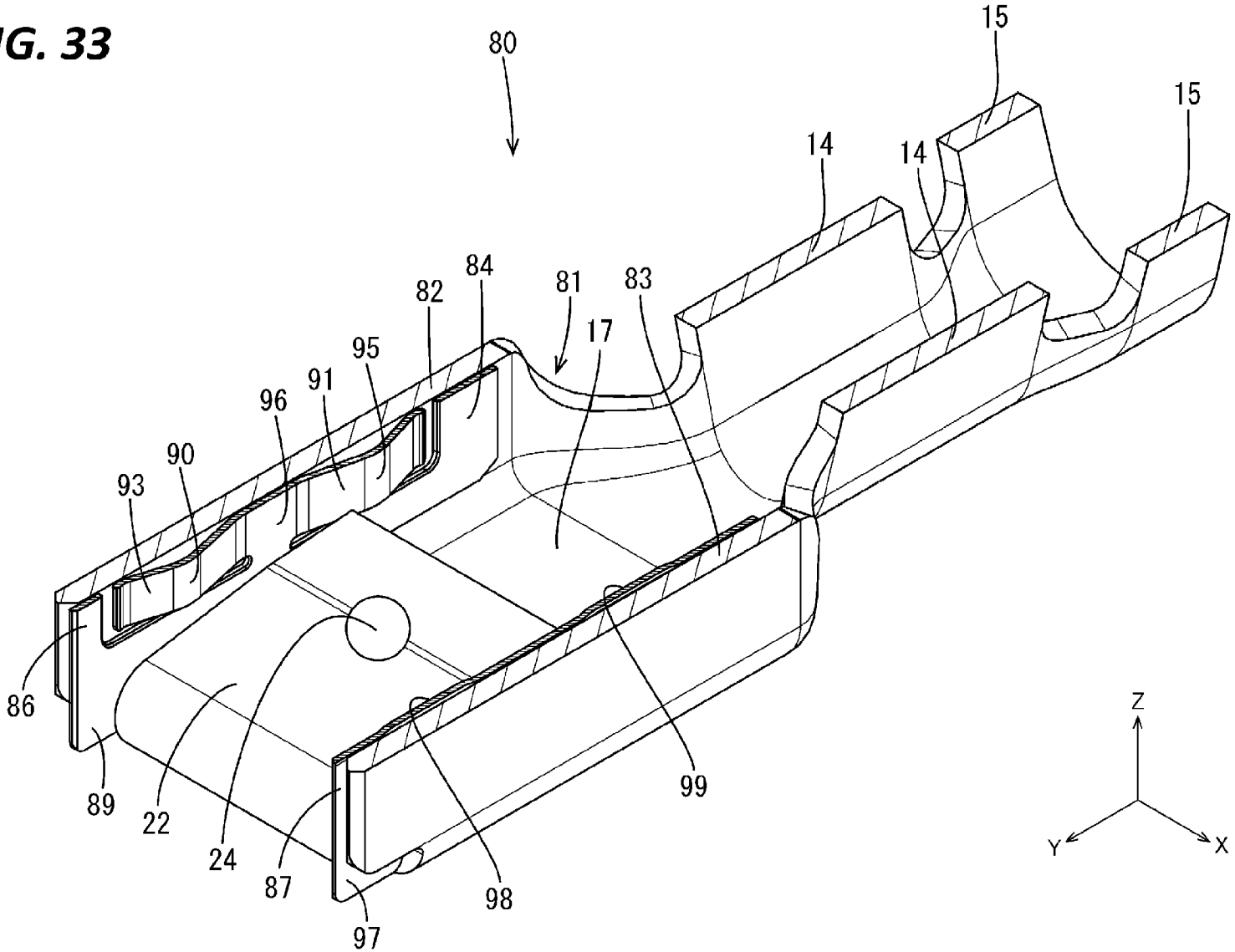
FIG. 33 is a perspective view partly in section showing the female terminal in the state where the spring structure is assembled.

As shown in FIGS. 32 and 33, the front pressing portion 93 of the front spring member 90, the contact protrusion 24 of the resilient contact piece 22 and the rear pressing portion 95 of the rear spring member 91 are disposed at positions shifted in the length direction. In particular, the front pressing portion 93 of the front spring member 90 is located at the most forward position, the contact protrusion 24 of the resilient contact piece 22 is located at the next position and the rear pressing portion 95 of the rear spring member 91 is located at the most rearward position in the length direction.

(Left Side Wall 87)

As shown in FIG. 28, a left locking portion 97 projecting downward is formed on a front end part of the left side wall 87 of the spring structure 84. The left locking portion 97 is locked to a cutout 23 provided in the bottom wall 17 of the terminal connecting portion 81 from front in the length direction, whereby the spring structure 84 is positioned in the length direction with respect to the terminal connecting portion 81.

Projecting Portions (Front Projecting Portion 98, Rear Projecting Portion 99)

Figure 34:
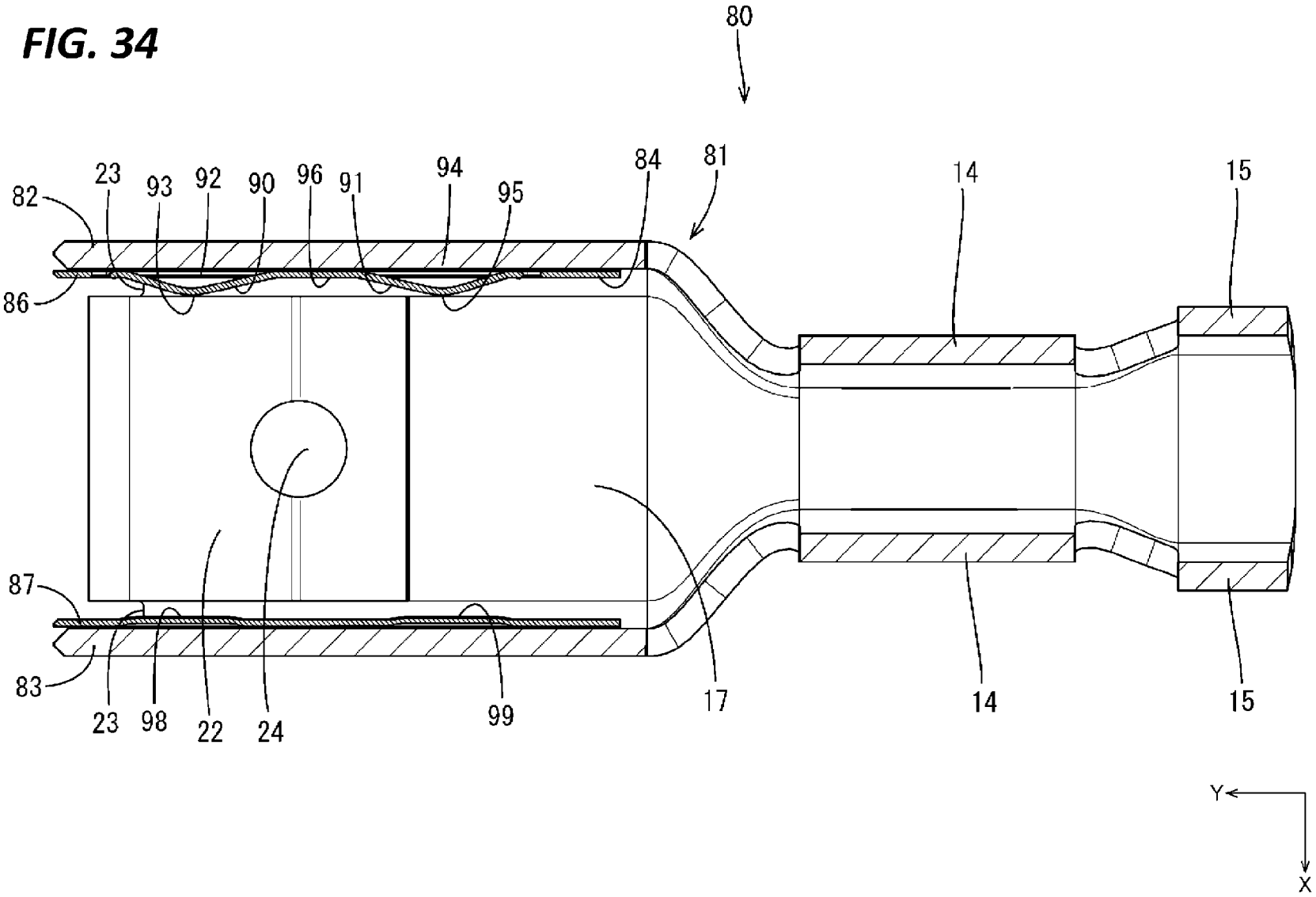
FIG. 34 is a plan view in section showing the female terminal in the state where the spring structure is assembled.

As shown in FIG. 34, the left side wall 18 of the spring member 84 is struck to provide a front projecting portion 98 projecting inward (rightward in the width direction) of the spring structure 84 on a front side in the length direction and a rear projecting portion 99 arranged side by side with the front projecting portion 98 across a gap in the length direction and projecting inward (rightward in the width direction) of the spring structure 84. The front projecting portion 98 is formed at a position corresponding to the front pressing portion 93 of the front spring member 90, and the rear projecting portion 99 is formed at a position facing the rear pressing portion 95 of the rear spring member 91.

An interval in the width direction between the front pressing portion 93 of the front spring member 90 in a state not resiliently deformed and the front projecting portion 98 is set to be smaller than a width of the male tab 12 of the male terminal 11. Further, an interval in the width direction between the rear pressing portion 95 of the rear spring member 91 in a state not resiliently deformed and the rear projecting portion 99 is set to be smaller than the width of the male tab 12 of the male terminal 11.

Since the configuration other than the above is substantially the same as in the first embodiment, the same components are denoted by the same reference signs and repeated description is omitted.

In this embodiment, the spring structure 84 formed with the front and rear spring members 90, 91 is a member separate from the terminal connecting portion 81 of the female terminal 80.

According to the above configuration, the front and rear spring members 90, 91 can be made of a material different from that of the terminal connecting portion 81 and formed to have a different thickness from that of the terminal connecting portion 81. In this way, restrictions due to the shape of the terminal connecting portion 81, the material constituting the terminal connecting portion 81 and the like can be reduced in designing the front and rear spring members 90, 91. As a result, a degree of freedom in designing the front and rear spring members 90, 91 is improved.

Other Embodiments

The technique disclosed in this specification is not limited to the above described and illustrated embodiments. For example, the following embodiments are also included in the technical scope of the technique disclosed in this specification.

(1) The terminal connecting portion, the resilient contact piece, the plurality of spring members and the projecting portion(s) may be all different members.

(2) One female terminal may include three or more spring members.

(3) A plurality of spring members may be provided in a left side wall of a terminal connecting portion, and projecting portion(s) may be provided on a right side wall.

(4) Arbitrary directions can be appropriately selected as extending directions of a plurality of spring members. For example, one of front and rear spring members may extend in the height direction, and the other may extend in the length direction.

LIST OF REFERENCE NUMERALS

10, 50, 60, 70, 80: female terminal
11: male terminal
12: male tab
13, 52, 62, 71, 81: terminal connecting portion
14: wire barrel
15: insulation barrel
16: insertion opening
17: bottom wall
18, 83, 87: left side wall
19, 53, 76, 82, 86: right side wall
20, 85: upper wall
22: resilient contact piece
23: cutout
24: contact protrusion
25: rib
26, 51, 72, 90: front spring member (example of spring member)
27, 54, 61, 74, 91: rear spring member (example of spring member)
28, 92: front slit
29, 73, 93: front pressing portion
30, 94: rear slit

31, 75, 95: rear pressing portion
32, 96: support wall
33: projecting portion
34: front end part of projecting portion
35: rear end part of projecting portion
84: spring structure
88: window portion
89: right locking portion
97: left locking portion
98: front projecting portion (example of projecting portion)
99: rear projecting portion (example of projecting portion)

What is claimed is:

1. A female terminal, comprising:

a terminal connecting portion extending along a length direction and including an insertion opening on a front end in the length direction, a male terminal being inserted into the insertion opening;

a resilient contact piece disposed inside the terminal connecting portion and configured to sandwich the male terminal between the terminal connecting portion and the resilient contact piece by resiliently contacting the male terminal from a height direction intersecting the length direction;

a plurality of spring members disposed side by side across a gap along the length direction inside the terminal connecting portion and configured to resiliently contact the male terminal from one side in a width direction intersecting the length direction and the height direction; and a projecting portion projecting from the other side in the width direction toward the one side in the width direction inside the terminal connecting portion and configured to sandwich the male terminal between the plurality of spring members and the projecting portion.

2. The female terminal of claim 1, wherein the plurality of spring members are integrally formed to the terminal connecting portion.

3. The female terminal of claim 1, wherein the plurality of spring members are members separate from the terminal connecting portion.

4. The female terminal of claim 1, wherein the plurality of spring members include a front spring member located on a front side in the length direction and a rear spring member located on a rear side in the length direction.

5. The female terminal of claim 4, wherein a spring constant of the front spring member is set to be smaller than that of the rear spring member.

6. The female terminal of claim 4, wherein the front spring member is formed to extend forward in the length direction, and the rear spring member is formed to extend rearward in the length direction.

7. The female terminal of claim 4, wherein one or both of the front and rear spring members is/are formed to extend in the height direction.

8. The female terminal of claim 4, wherein:

the front spring member includes a front pressing portion configured to contact the male terminal, the rear spring member includes a rear pressing portion configured to contact the male terminal, the projecting portion is formed to extend along the length direction, and a front end part of the projecting portion is located forward of the front pressing portion of the front spring member and a rear end part of the projecting portion is located rearward of the rear pressing portion of the rear spring member in the length direction.

9. The female terminal of claim 4, wherein:

the front spring member includes a front pressing portion configured to contact the male terminal, the rear spring member includes a rear pressing portion configured to contact the male terminal, and the resilient contact piece includes a contact protrusion configured to be located between the front and rear pressing portions in the length direction and contact the male terminal.

* * * * *